US006004021A

United States Patent [19]

Rothbarth

[11] Patent Number: 6,004,021

[45] Date of Patent: Dec. 21, 1999

[54] TOY SYSTEM INCLUDING HARDWARE TOY PIECES AND TOY DESIGN SOFTWARE FOR DESIGNING AND BUILDING VARIOUS TOY LAYOUTS USING THE HARDWARE TOY PIECES

[75] Inventor: James N. Rothbarth, St. Louis, Mo.

[73] Assignee: Chaos, L.L.C., St. Louis, Mo.

[21] Appl. No.: 08/719,955

[22] Filed: Sep. 24, 1996

Related U.S. Application Data

[60] Provisional application No. 60/004,448, Sep. 28, 1995.

[51] Int. Cl.[6] ..... G06F 9/455

[52] U.S. Cl. ..... 364/578

[58] Field of Search ..... 364/578, 512, 364/468.03; 395/500, 919; 345/964, 353

[56] References Cited

U.S. PATENT DOCUMENTS

| | | | |
|---|---|---|---|
| 1,260,664 | 3/1918 | Gregory . | |
| 1,400,066 | 12/1921 | Huck . | |
| 1,714,433 | 5/1929 | Molnar . | |
| 3,581,987 | 6/1971 | Tomaro | 238/10 E |
| 3,782,729 | 1/1974 | Ernst | 273/138 |
| 3,946,516 | 3/1976 | Wirth | 46/17 |
| 4,128,964 | 12/1978 | Ogasawara | 46/43 |
| 4,171,090 | 10/1979 | Eisenburg | 238/10 R |
| 4,414,629 | 11/1983 | Waite | 364/300 |
| 4,646,238 | 2/1987 | Carlson, Jr. et al. | 364/403 |
| 4,847,784 | 7/1989 | Clancey | 364/513 |
| 4,874,342 | 10/1989 | Klitsner | 446/168 |
| 4,887,218 | 12/1989 | Natarajan | 346/468 |
| 4,924,385 | 5/1990 | Dote | 364/300 |
| 4,933,871 | 6/1990 | DeSieno | 364/513 |
| 4,939,680 | 7/1990 | Yoshida | 364/513 |
| 4,964,043 | 10/1990 | Galvin | 364/401 |
| 5,121,330 | 6/1992 | Blaha et al. | 364/468 |
| 5,172,313 | 12/1992 | Schumacher | 364/401 |
| 5,193,182 | 3/1993 | Bachman et al. | 395/600 |
| 5,282,767 | 2/1994 | Gelardi | 446/126 |
| 5,293,479 | 3/1994 | Quitero et al. | 345/353 |
| 5,349,659 | 9/1994 | Do et al. | 395/700 |
| 5,359,523 | 10/1994 | Talbott et al. | 364/468.03 |

*Primary Examiner*—Kevin J. Teska
*Assistant Examiner*—Dan Fiul
*Attorney, Agent, or Firm*—Senniger, Powers, Leavitt & Roedel

[57] ABSTRACT

The Toy System is a toy for use with a computer having a display. The system includes a plurality of interconnecting hardware toy pieces and a toy design system software for operating the computer. An inventory database stores an inventory of the toy pieces. An inventory database manager module updates the inventory database in response to player input. A design layout module creates and modifies a toy layout in response to player input using software representations corresponding to the inventory of the toy pieces and conforming to a plurality of design rules, and generates a screen indicating the toy layout. A layout database stores the toy layout created by the player using the toy design system. Other features includes inventory management and control allowing a layout based on a fixed inventory, a layout completion module, a layout library module, a design assistance module, a simulation module and an education module. The hardware pieces may be a moveable element, such as a ball, and tracks, support pieces and stunt pieces, for guiding the ball.

15 Claims, 27 Drawing Sheets

START
300
GET COMMAND FROM PLAYER INPUT
302
REVIEW OR UPDATE INVENTORY ?
304
Y
N
EXECUTE INVENTORY DATABASE MANAGER MODULE 108
306
REVIEW OR UPDATE EDUCATION LEVEL ?
308
Y
N
EXECUTE EDUCATION LEVEL SELECTOR MODULE 124
310
LIST GAME LAYOUTS IN THE LAYOUT DATABASE ?
312
Y
EXECUTE LAYOUT LIBRARY MODULE 114
314
1A
1B 2A
1B
316
SIMULATE GAME ?
Y
318
EXECUTE SIMULATION MODULE 120
N
320
TEACH SCIENCE & MATHEMATICAL PRINCIPLES ?
Y
322
EXECUTE EDUCATION MODULE 122
N
324
CHECK GAME LAYOUT TO SEE IF CAN BUILD WITH INVENTORY ?
Y
326
EXECUTE LAYOUT COMPLETION MODULE 112
N
328
REQUEST DESIGN SUGGESTION ?
Y
330
EXECUTE DESIGN ASSISTANCE MODULE 116
N
2A
2B

TOY SYSTEM INCLUDING HARDWARE TOY PIECES AND TOY DESIGN SOFTWARE FOR DESIGNING AND BUILDING VARIOUS TOY LAYOUTS USING THE HARDWARE TOY PIECES

CROSS-REFERENCE TO RELATED APPLICATION

This is based on and claims priority from U.S. patent application Ser. No. 60/004,448 filed Sep. 28, 1995, the entire disclosure of which is incorporated herein by reference. The entire disclosure of co-assigned U.S. patent application Ser. No. 08/719,951 titled Kinetic Toy invented by James N. Rothbarth and Alex K. Lee and filed simultaneously herewith is incorporated herein by reference.

BACKGROUND OF THE INVENTION

This invention relates to a combination hardware and software toy system, and, in particular, toy design system software for designing toy layouts that can be built using interconnecting hardware toy pieces.

Various toys with hardware pieces exist that allow the construction of structures, buildings, vehicles or tracks, including erector sets, race car tracks, and railroad tracks. There are drawing software programs that allow the player to draw a picture the player desires, including structures, buildings, vehicles and tracks. However, the two domains of toys with hardware pieces and software drawing programs have not been combined to provide a useful toy that will easily allow the player to design a toy layout that can be built using the hardware toy pieces. In the prior art, a player could use a drawing program that does not consider the inventory of hardware toy pieces. Alternatively, a player could commence building a toy layout with the hardware toy pieces without knowing the outcome. In either case, the player had no assurance that the toy layout could be completed using the limited quantity of hardware toy pieces available to the player. Furthermore, the player has no assurance that the toy layout will function properly until it is built using the hardware toy pieces.

OBJECTS AND SUMMARY OF THE INVENTION

It is therefore a primary object of this invention to provide a combination hardware and software toy system. More specifically, it is an object to provide toy design system software using software representations of the hardware toy pieces to design toy layouts that can be built using the hardware toy pieces.

A more particular objective of this invention is for the toy design system software to indicate to the player when the toy layout uses more of a particular software representation of a hardware toy piece than the quantity of the corresponding toy piece in the inventory of the hardware toy pieces.

It is also an objective for the toy design system software to constrain the toy layout to conform with a plurality of design rules that substantially represent the laws of physics, as well as constraints imposed by the physical properties of the hardware toy pieces.

A further objective is for the toy design system software to simulate the toy layout and substantially real-time motion of any moveable element toy pieces.

Another objective of this invention is to be a teaching tool as well as an entertaining way of explaining the mathematical and scientific principles associated with the toy layout and the movement of any moveable toy piece. It is a further objective to explain the mathematical and scientific principles at the education level corresponding to the education level of the player.

A further objective is to provide a system which assists the player in efficiently designing a functional toy layout by indicating design suggestions.

An additional object is to provide a system which stores a plurality of toy layouts; with a further object of being able to recall those stored toy layouts so that the layouts can be physically built using the hardware toy pieces in the player's inventory of toy pieces.

Further objects and advantages of the invention will become apparent from a consideration of the drawings and ensuing description of the invention and its preferred embodiments.

To accomplish these and related objects, a toy comprises hardware toy pieces and toy design system software for designing layouts that use the hardware toy pieces. The toy design system software includes an inventory database to store the inventory of the toy pieces, an inventory database manager module for updating the inventory database, a design layout module for creating and modifying a toy layout in conformance with a plurality of design rules as well as generating a screen indicating the toy layouts and a layout database storing the toy layout. Limitless accessories may be added to expand the software or hardware toy pieces.

BRIEF DESCRIPTION OF THE DRAWINGS

The accompanying drawings form a part of the specification and are to be read in conjunction therewith and in which like reference numerals are used to indicate the like parts in the various views:

FIGS. 26–40 illustrate various stunts and/or parts therefor according to the invention.

FIG. 26 illustrates a carriage with mortar.

FIG. 27 illustrates an elevator head and unloader.

FIG. 28 illustrates a motor mount and ball guide loader.

FIG. 29 illustrates a pendulum gate support.

FIG. 30 illustrates a gate mounting clip.

FIG. 34 illustrates a dual pulley elevator exchange with four part tackle.

FIG. 35 illustrates an alternating vertical gate.

FIG. 36 illustrates a spiral spring.

FIG. 37 illustrates a barrel roll.

FIG. 38 illustrates a swinging gate randomizer.

FIG. 39 illustrates a volute launcher.

FIG. 40 illustrates a chime cascade.

DETAILED DESCRIPTION OF PREFERRED EMBODIMENTS

The invention combines a software design system as illustrated in FIGS. 1–3D and interconnecting hardware pieces as illustrated in FIGS. 4A–15. The player can design a toy layout using the toy design system software on a computer using software representations of the inventory of hardware toy pieces which the player has. The player can design a track layout using the software package which would preferably be stored on a CD-ROM and loaded into the computer. The software indicates inventory constraints and design suggestions as the player is designing the toy layout providing a more efficient design process. By including design rules that emulate the laws of nature and physical interconnection properties of the hardware toy pieces, as well as software for substantially real-time simulation of the toy, the software indicates to the player whether the toy layout for the hardware pieces as designed on the toy design system software will function properly. After completing the design with the software, the player then builds the design using the interconnecting hardware pieces. The software instructs the player by providing step-by-step instructions for building the design. Alternatively, the software can provide a layout or blueprint which the player may follow. By incorporating toy design system software and hardware toy pieces into a single toy, the toy also becomes a learning experience for the player. The software system explains the underlying mathematical and scientific principles as the toy layout is designed.

Figure 1:
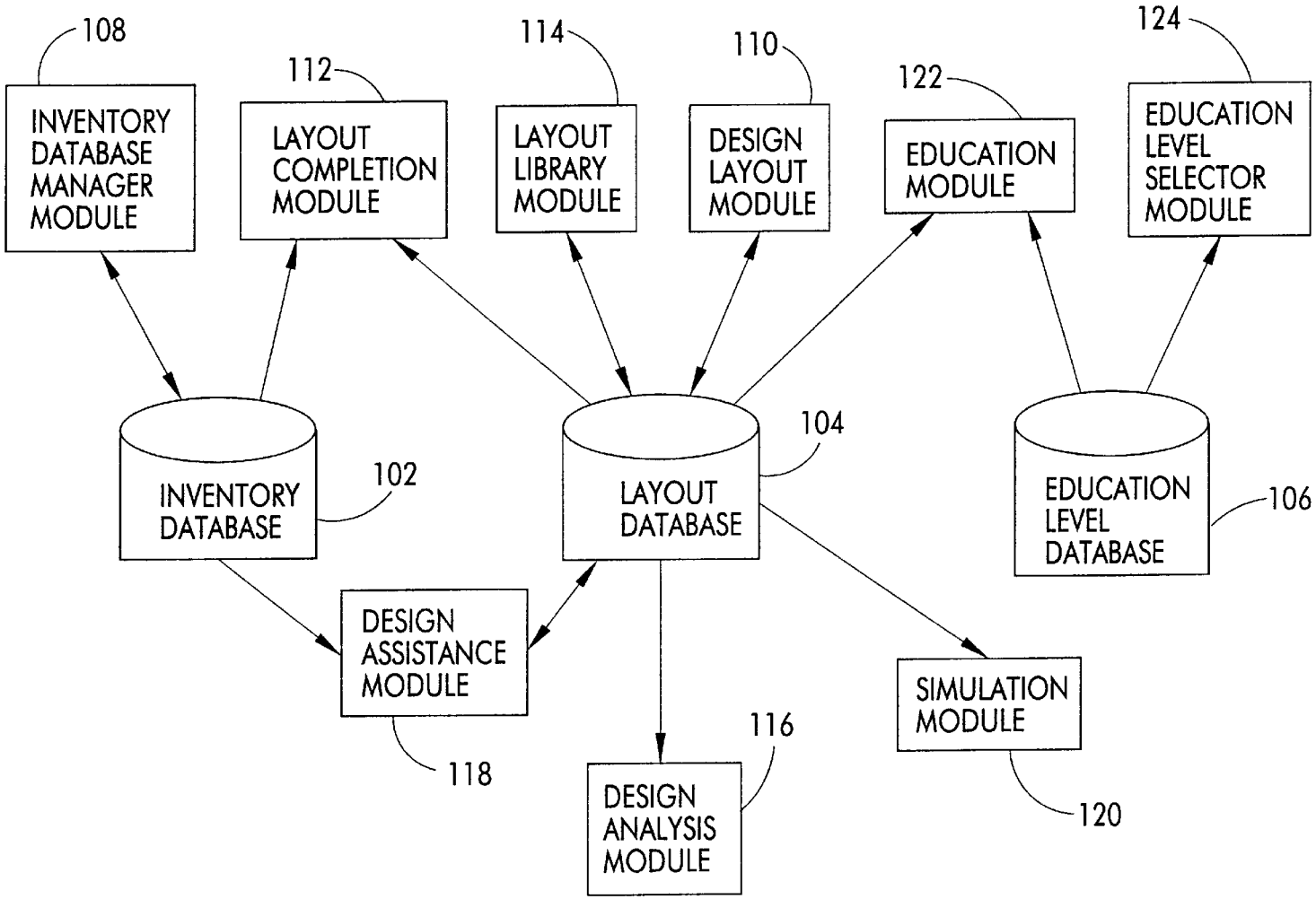
FIG. 1 shows a block diagram illustrating the relationship between the databases and modules of one preferred embodiment of the toy design system software according to the invention.

The toy design system software as illustrated in FIG. 1 comprises three databases: an inventory database 102, a layout database 104, and an education level database 106. Conceptually, the databases are perpetual storage devices without specific implementation that include such things as disks and memory. Inventory database 102 is a file which maintains an inventory of the hardware toy pieces and of the particular predetermined number of toy pieces which are owned by the player. Layout database 104 is a storage repository for a toy layout and may include one or more preset layouts that can be selected by the player. The education level database 106 stores the education level of the player and various instructions for educating the player based on various education levels.

Initially, the player would purchase the toy design system software and a finite number of hardware toy pieces. Using the software, the player would enter into the inventory database 102 the specific types and numbers of pieces which the player has purchased or otherwise owns. An inventory database manager module 108 allows the player to update the inventory of the toy pieces initially or at a later date when additional pieces are purchased or broken.

Next, the player would access a design layout module 110 which accepts commands from the player and has the function of constructing a toy layout according to the design rules stored in the layout database 104. Layout completion module 112 monitors the player's work through the design layout module 110 and compares the toy layout with the inventory stored in inventory database 102 to determine if the toy layout can be built with the inventory of toy parts on hand. This monitoring may happen continuously in real time or may be at intervals either preset or selected by the player or may be accessed only at the end of a design layout cycle.

In the course of designing, the player may opt to use a layout library module 114 which lists various toy layouts stored in the layout database 106. Layout library module 114 will only access those layouts within the layout database 104 that can be built with the current inventory. Optionally, layout library module 114 may have a function of deleting toy layouts from the layout database 104 or may have an optional function of adding additional layouts. Also, during the design cycle, a design assistance module 116 may provide layout suggestions to the player while the player is designing the toy layout. For example, design assistance module 116 could provide a list of the types of track pieces that may be added next and still be consistent with the design rules.

Also, a design analysis module 118 analyzes the toy layout as the player develops it to ensure that the toy layout will function properly. For example, in the preferred embodiment described herein, a ball constitutes a movable element which is guided through various stages and is also directed by a series of straight or curved tri-rail toy pieces. One function of the design assistance module 118 would ensure that the movable element continuously moves in the same direction about the toy layout. Preferably, this module 118 is only activated when called upon by a player request. However, it is also contemplated that the design assistance module 118 may automatically check the design of the player, in addition to the design rule checks made by the design layout module 110, after each hardware toy piece is added to the layout. Optionally, the player may also have access to a simulation module 120 which could provide various real time simulations of the layout being developed or of any other layouts stored in the layout database 104. The simulation module would rely on the design analysis module 116 for the underlying algorithms and calculations necessary to simulate real-time operation of a particular layout.

The toy design system software according to the invention may also include an education module 122 for providing instructions to the player based on the scientific and mathematical principles relevant to the toy layout and movement of the movable element. Additionally, the system software may include an education level selector module 124 that allows the player to select the education level stored in the education level database 106 which will be used by the education module 122 to instruct the user. It is also contemplated that the education level selector module 124 may adjust the education level at which the player is being instructed based on various input from the player such as the player's age, education, ability to understand various concepts and level of design complexity which is being executed by the player.

Figure 2:
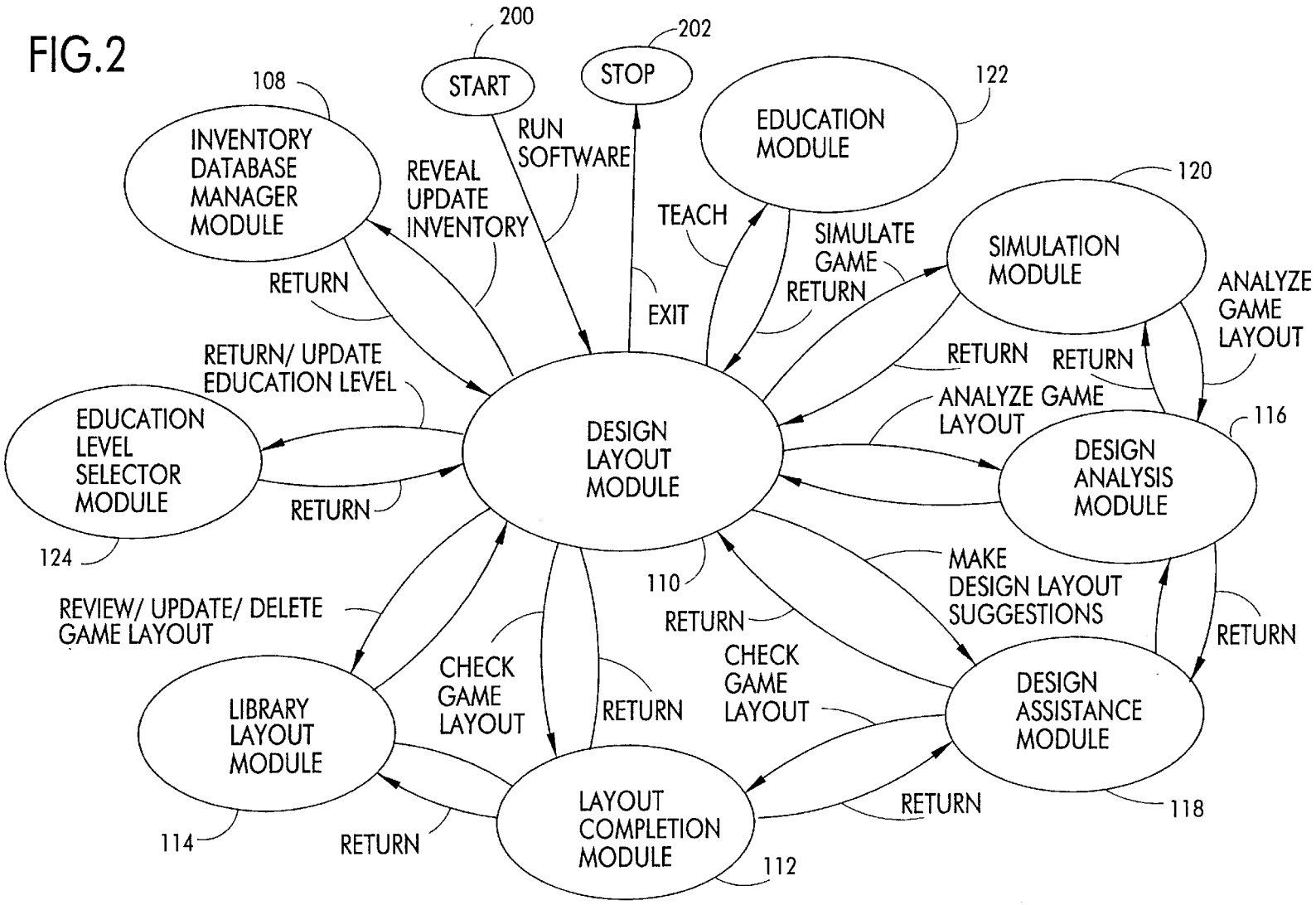
FIG. 2 shows a data flow diagram of one preferred embodiment of the toy design system software according to the invention showing various modules and the interaction between modules.

FIG. 2 shows a data flow diagram of one preferred embodiment of the toy design system software according to the invention showing various design modules and the interaction between modules. Beginning at the start step 200 and proceeding counter clockwise to the stop step 202, FIG. 2 illustrates one preferred embodiment of the steps involved in using the toy design system software. Initially, a player would use the inventory database manage module 108 to review and/or update inventory stored in the inventory database 102. Next, the player would use the education level selector module 124 to review and/or update an education level which will be established for the particular toy cycle to be played or for future toy cycles. This level will be used by the education level database 106 to provide various instructions or teachings to the player.

Next, the player would access the library layout module 114 to review, update and/or delete a particular toy layout that is being created or developed. The library layout module 114 would access the layout database 104 and modify it according to the player's instructions. In the course of using the library layout module 114, the software may also check the toy layout automatically or at the player's instructions by using the layout completion module 112. Layout completion module 112 would compare the inventory database 102 with the layout database 104 to ensure that sufficient hardware toy pieces are available to build the layout being designed.

In addition, the software may automatically or the player may manually access design assistance module 118 which would provide instructions to the player for certain design layout suggestions according to the inventory database 102 and according to the state of the design being developed and stored in layout database 104.

The player could also access, either automatically or manually, the design assistance module 116 which would analyze the toy layout being developed in the layout database 104 and provide the player with instructions and advice as to the feasibility and operation of the layout being developed. Part of this design analysis may include access to and operation of simulation module 120 for simulating toy operation either as an amusement to the operator or to illustrate to the operator how the hardware toy pieces would operate if built according to the layout stored in layout database 104.

Finally, the education module 122 could be automatically or manually activated to teach the player as the layout is being developed in the layout database. Alternatively, the education module 122 may proceed through a preprogrammed learning sequence after the layout is complete, the sequence based on the complexity of the layout and the various types of hardware toy pieces that are used in the layout.

Referring to FIGS. 3A–3D, a flow chart of one preferred embodiment of the toy design system software according to the invention is illustrated. After starting at step 300, the software proceeds to step 302 requesting a command from the player or other input from the player. If the player indicates a command to review or update the inventory, step 304 executes the inventory database manager module at step 306. Otherwise, the software proceeds to step 308. If the player instructs the software to review or update an education level, the software proceeds to step 310 to execute the education level selector module. Otherwise, the software proceeds to step 312 which executes the layout library module at step 314 if the player has instructed the software to list toy layouts in the layout database.

Figure 3A:
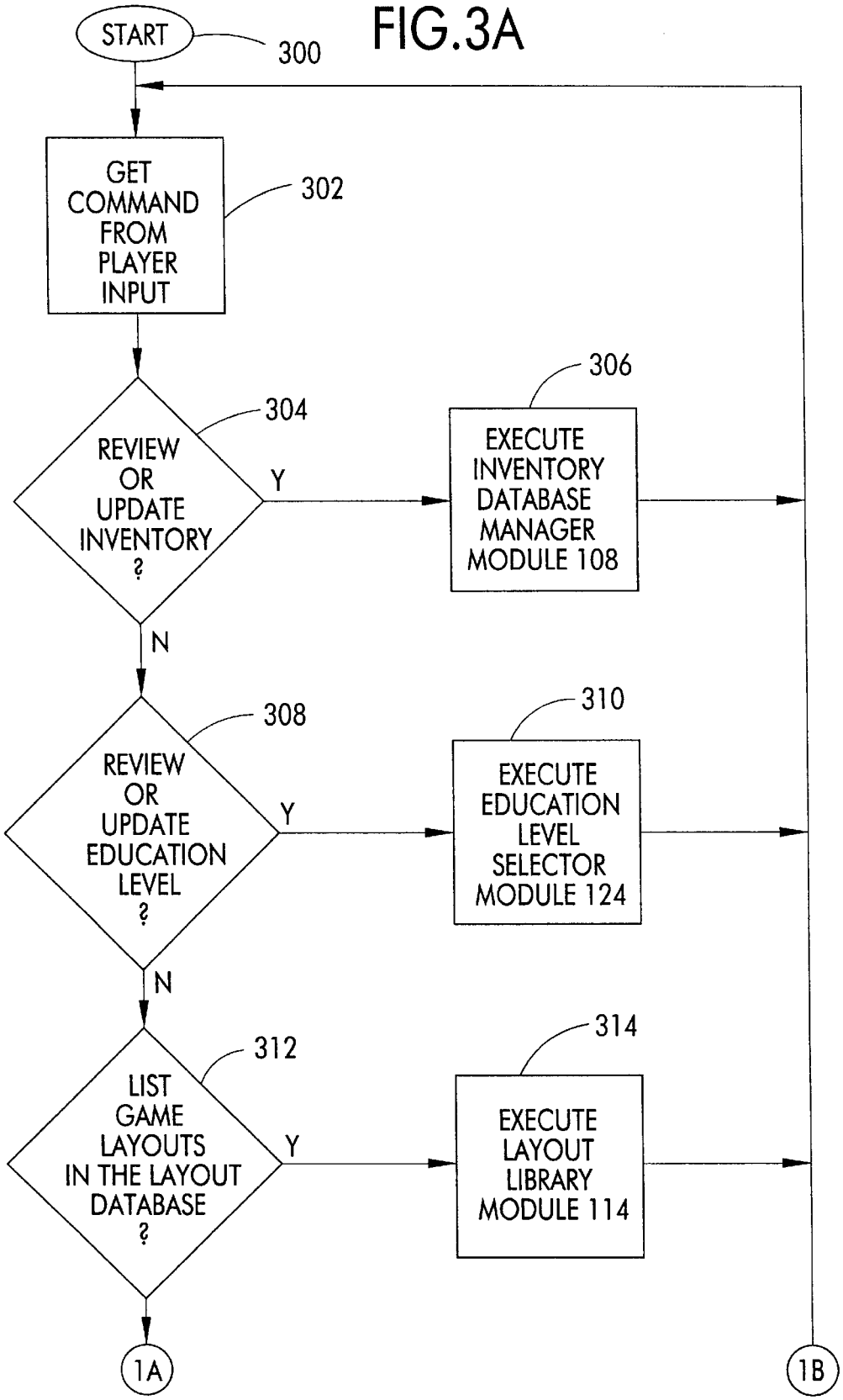
FIGS. 3A–3D comprise a flow chart of one preferred embodiment of the toy design system software according to the invention.
Figure 3B:
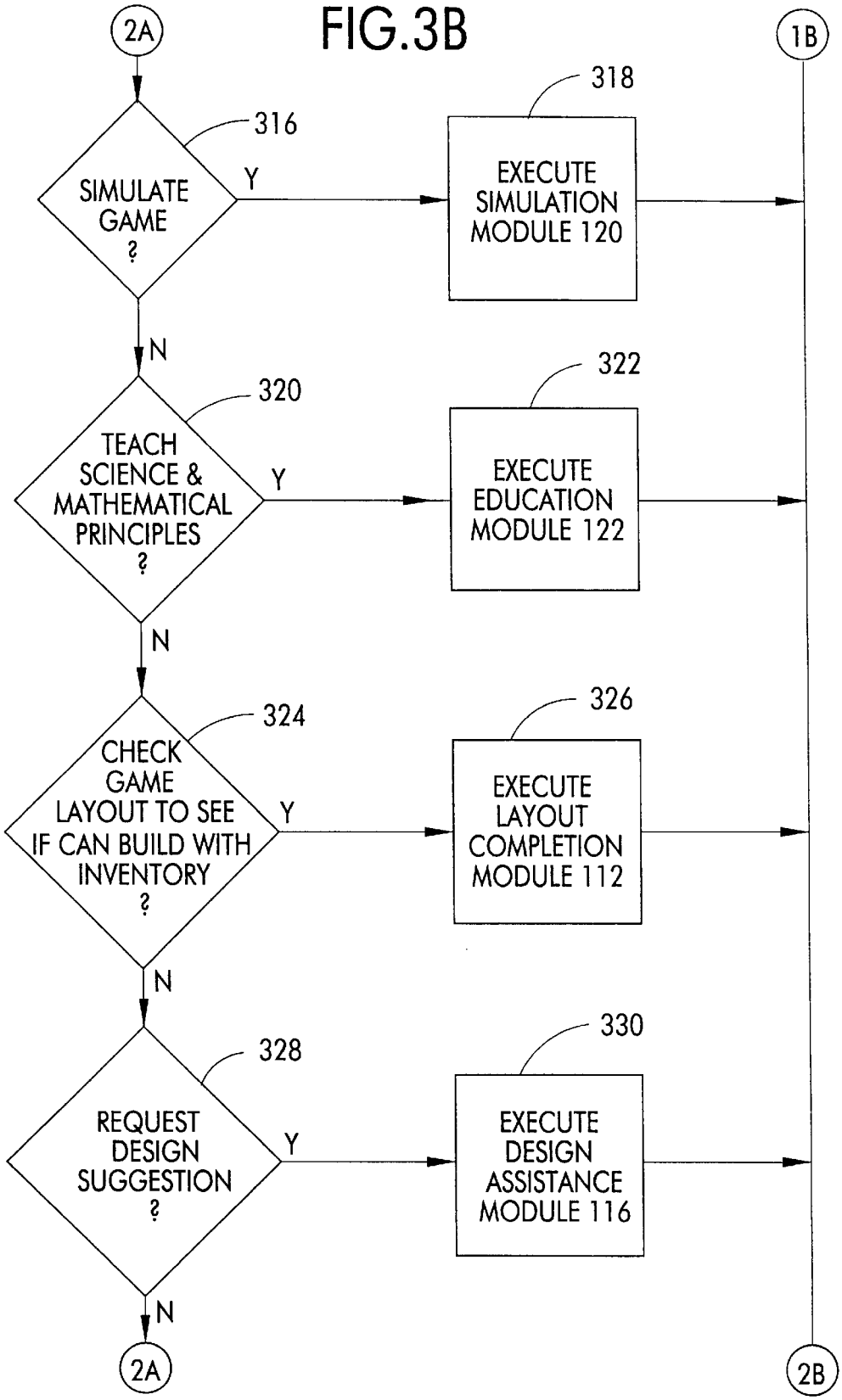

Otherwise, as shown in FIG. 3B, the software proceeds to step 316 which executes the simulation module at step 318 if the player requests a simulation. Otherwise, the software proceeds to step 320 which executes the education module at step 322 if the player has requested a teaching with regard to scientific or mathematical principles involved. Otherwise, the software proceeds to step 324 which executes the layout completion module at step 326 if the player has instructed the software to check the toy layout to determine whether the player can be built with the existing inventory as stored in the inventory database 102. Otherwise, the software proceeds to step 328 and executes the design assistance module at step 330 if the player has requested a design suggestion.

Figure 3C:
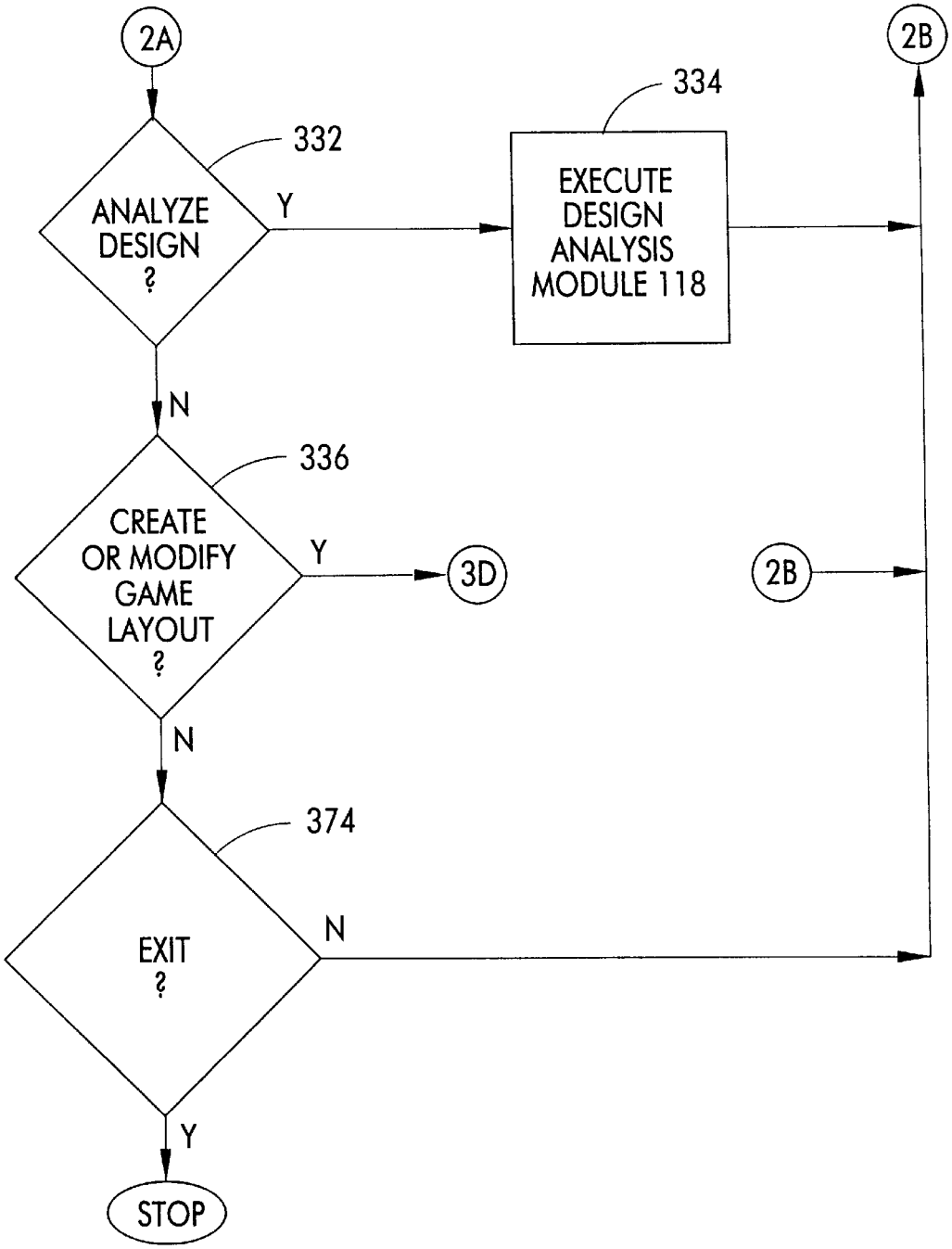

Otherwise, as shown in FIG. 3C, the software proceeds to step 332 and executes design assistance module at step 334 if the player has requested design analysis. Otherwise, the software proceeds to step 336 which executes the flow chart of FIG. 3D if the player has instructed the software to create or modify the toy layout.

Figure 3D:
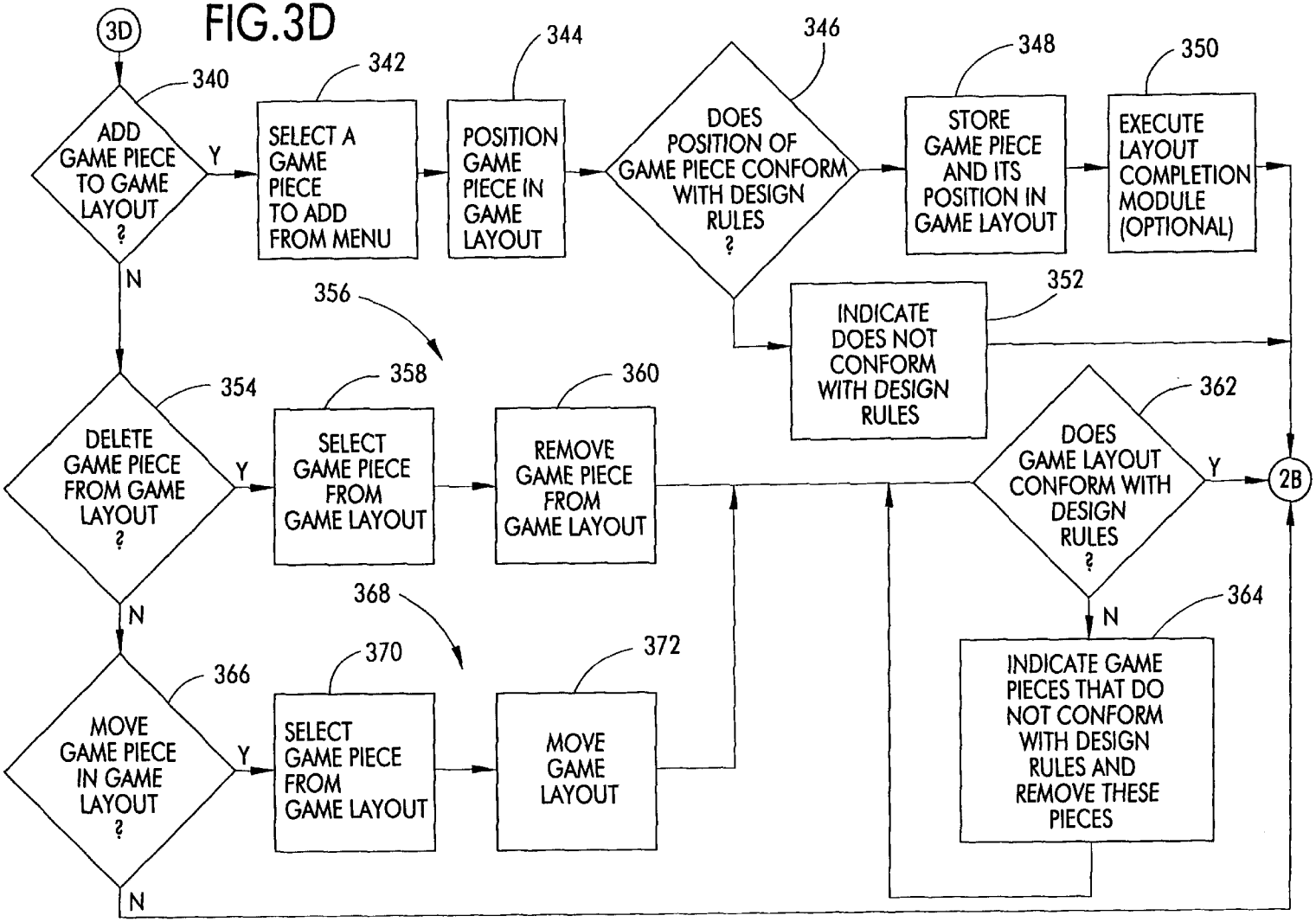

In particular, as shown in FIG. 3D, an add loop 338 is executed if the player instructs the software to add a toy piece to the toy layout at step 340. Add loop 338 includes step 342 which allows the player to select a toy piece from the inventory database 102 to be added to the layout. This is followed by step 344 which positions the toy piece in the toy layout. At step 346, the software indicates to the player whether the position of the toy piece conforms with the design rules by executing steps 348 and 350 to store the toy piece in its position and the toy layout and to execute the layout completion module (optional) or the software indicates that the toy piece does not conform with design rules by executing step 352.

If the player decides not to add a toy piece to the toy layout at step 340, the software proceeds to step 354 and executes delete loop 356 if the player instructs the software to delete a toy piece from the toy layout. The delete loop 356 includes step 358 which allows the player to select a toy piece from the toy layout which is to be deleted. Step 360 is also executed to remove the toy piece from the toy layout. If the toy layout with the deleted piece conforms with design rules, step 362 indicates such, or the software proceeds to step 364 to indicate the toy pieces which do not conform with the design rules and removes these pieces. At this point, the software returns to step 362 to confirm that the modified toy layout conforms to the design rules.

If the player decides not to delete a toy piece at step 354, the software proceeds to step 366 which executes move loop 368 if the player would like to move a toy piece in the toy layout. Move loop 368 includes step 370 which allows the player to select the toy piece from the toy layout which is to moved and step 372 which performs the movement instructed by the player. Thereafter, the software proceeds to step 362 to confirm that the modified layout conforms to the design rules.

Finally, the software is exited at step 374, if instructed by the player. Otherwise, after execution of any or all of the above modules, the software proceeds back to start step 300 awaiting further instructions from the player.

It is noted that FIGS. 3A–3D do not include a step which specifically indicates execution of the design layout module 110. This module 110 is the main module and essentially is executed by each of the primary steps beginning with step 302. In other words, step 302 provides a command from the player which then activates the design layout module 110 to allow the software to continue to operate. This is also shown in FIG. 2 which illustrates that all other modules interact with the design layout module 110.

Although FIGS. 3A–3D illustrate one preferred embodiment of software operation, it is clear to those skilled in the art that other ways of ordering the various module executions or overlapping loops for simultaneously executing various modules is also possible. For example, the simulation module can be executed at any point in the flow chart and at several points in the flow chart. FIGS. 3A–3D are essentially a sequential operation of each module at least once in order to illustrate one preferred embodiment of the software according to the invention.

FIGS. 4A–15 illustrate the hardware toy pieces according to the invention. After the player has completed the design using the software, the player is then provided with instructions for actually, physically building the layout with the hardware toy pieces in the player's possession. These instructions may be in the form of step-by-step written instructions provided by a printout or shown on a screen of the computer. Alternatively, the computer may printout a blue print or other schematic of the design developed by the player so that the player can be assisted in actually building the hardware toy pieces into the layout which has been designed in the computer.

Figure 4:
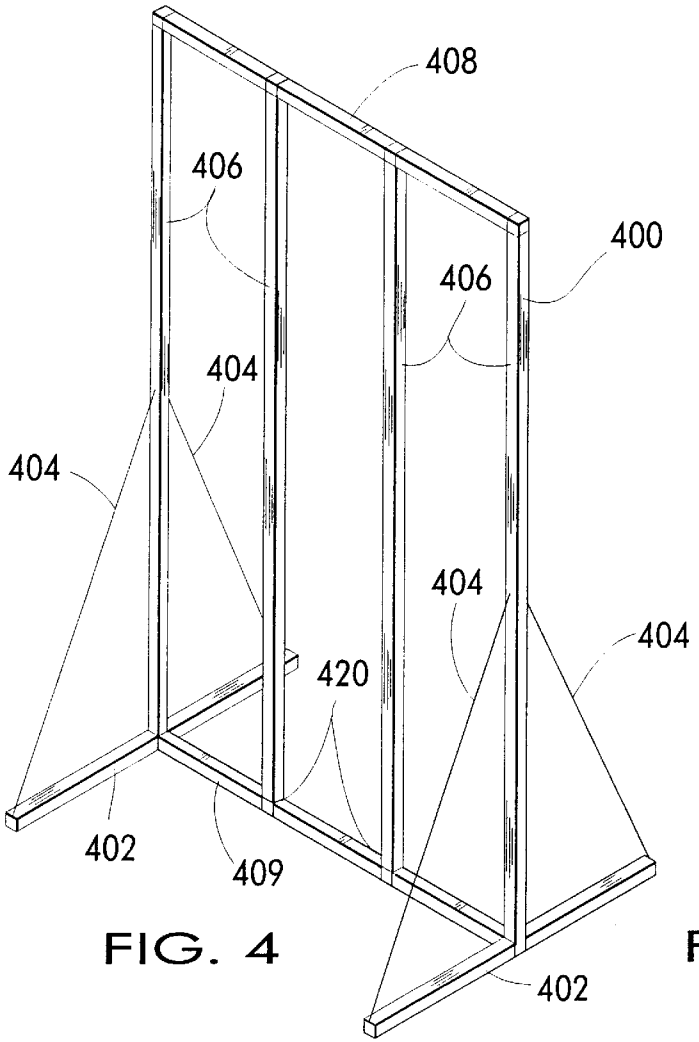
FIG. 4 is a perspective illustration of one preferred embodiment of a basic plane support structure according to the invention on which tracks forming a path for the movable element are supported and built.

FIG. 4 illustrates one preferred embodiment of a basic plane support structure which would be used to support and build a track configuration according to the design layout developed by the software. In general, the structure has a vertical planar structure 400 which is supported in place by two horizontal legs 402 which would rest on a floor or table and which is held in place by guide wires 404 which interconnect the center portion of the plane structure 400 with the ends of the legs 402. The plane structure 400 is preferably comprised of four vertical supports 406 and two horizontal supports 408 which are connected to the ends of the vertical supports.

Figure 5:
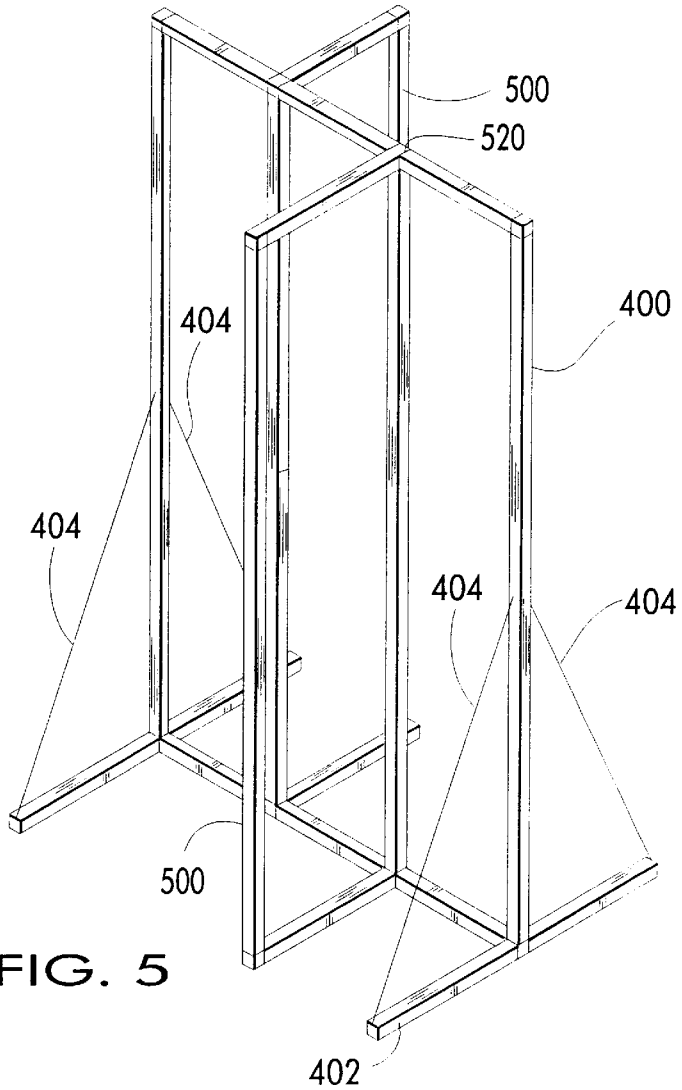
FIG. 5 is another preferred embodiment of the basic plane support structure of FIG. 4 including lateral extensions.

The structure 400 is infinitely expandable. For example, as shown in FIG. 5, vertical planar wings 500 may be added to the vertical plane structure 400 in order to accommodate other types of track designs. In general, it is contemplated that the software would analyze a completed design and recommend a support structure for the particular completed design. Preferably, the structure would be made from half inch or one inch square aluminum extrusion which would be in a standard length of approximately one foot or four feet. The lengths of extrusion would be joined by various joints as illustrated in FIGS. 6 and 6A–6J.

Figure 6:
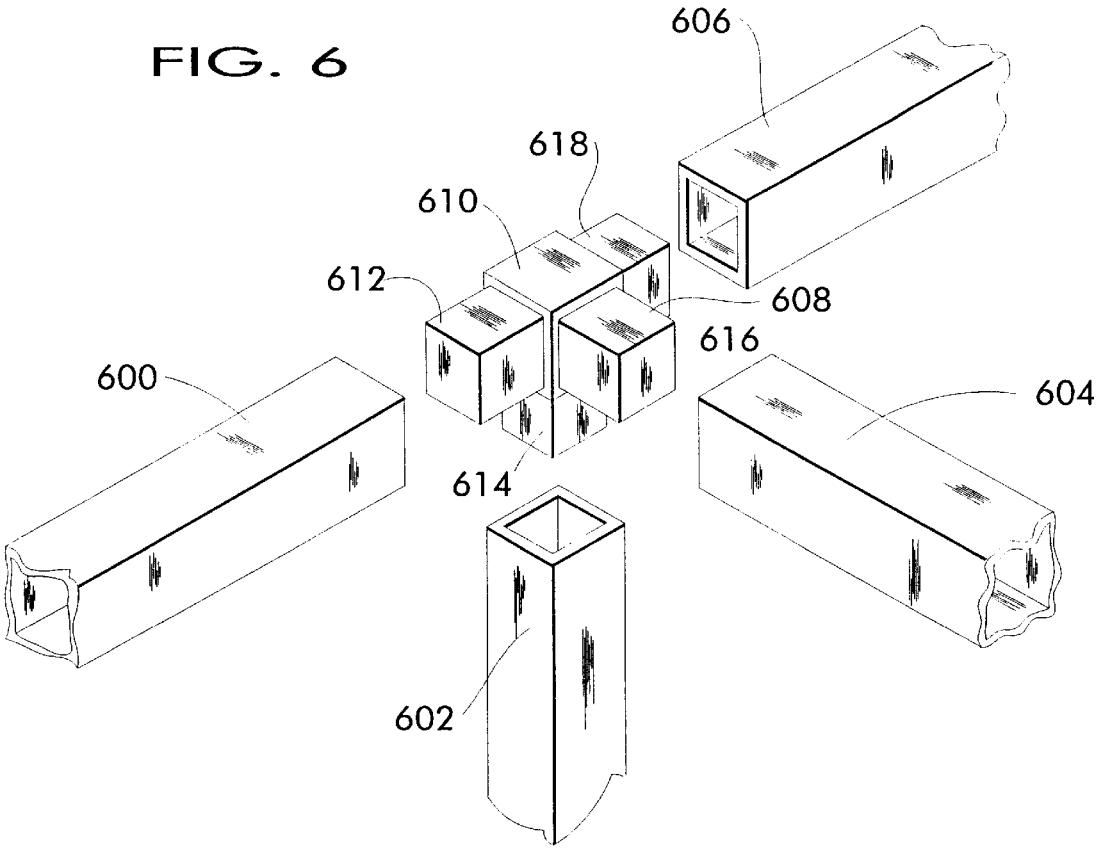
FIG. 6 is an exploded, expanded illustration of a 4-way corner of support structure according to the invention.

FIG. 6 illustrates a 4-way connector 520 in which four extruded members 600, 602, 604 and 606 are orthogonally joined together. Members 600 and 606 are in line with each other while members 602 and 604 are perpendicular thereto and each other. The 4-way molded joint 608 is shown in perspective in FIG. 6 and includes a base 610 with rectangular projections 612, 614, 616, and 618 sized to fit within the internal bore of the members 600, 602, 604, and 606, respectively.

Figure 6A:
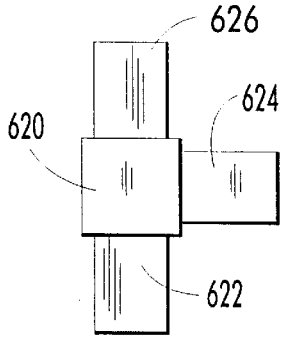
FIGS. 6A and 6D are top And side views of a 3-way tee connector according to the invention.
Figure 6B:
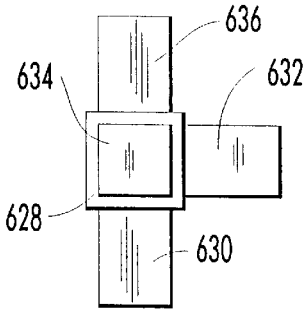
FIGS. 6B and 6E are top and side views of a 5-way connector according to the invention.
Figure 6C:
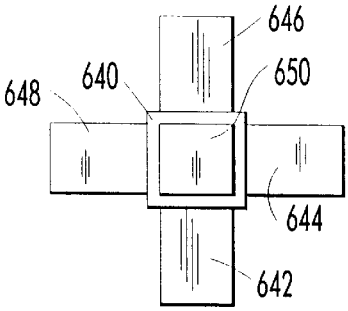
FIGS. 6C and 6F are top and side views of a 6-way connector according to the invention.
Figure 6D:
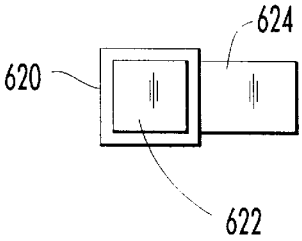

FIGS. 6A and 6D illustrate a 3-way connector 420 having a base 620 and projections 622, 624, and 626. Projections 622 and 626 are opposite each other to engage two in-line extrusions whereas projection 624 is perpendicular thereto for engaging an extrusion which would be perpendicular to the in-line extrusions. In other words, the 3-way connector of FIGS. 6A and 6B would form a "T" structure when joined with extrusions.

Figure 6E:
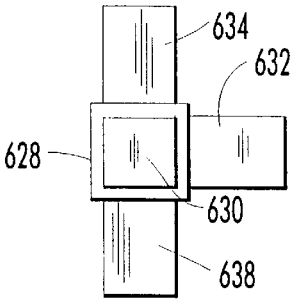

FIGS. 6B and 6E illustrate a 5-way connector including a base 628 having projections 630, 632, 634, 636, and 638. Projections 630 and 636 are opposite each other to join in-line extrusions and projections 634 and 638 are opposite each other to join additional in-line extrusions perpendicular to the first in-line extrusions and perpendicular to an extrusion engaging projection 632.

Figure 6F:
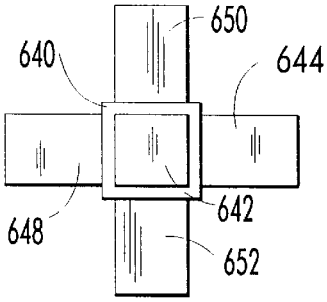

FIGS. 6C and 6F illustrate a 6-way connector having a base 640 and projections 642, 644, 646, 648, 650, and 652. Projections 642 and 646, 644 and 648, and 650 and 652 form opposing pairs for joining two in-line extrusions which would be orthoginal with the other in-line extrusions.

Figure 6G:
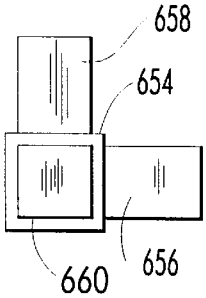
FIGS. 6G and 6I are top and side views of a 3-way corner connector according to the invention.
Figure 6H:
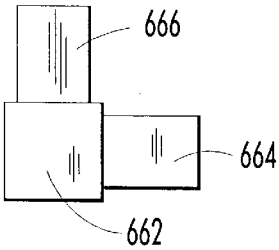
FIGS. 6H and 6J are top and side views of a 2-way corner connector according to the invention.
Figure 6I:
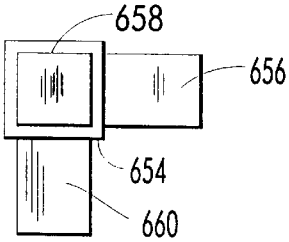
Figure 6J:
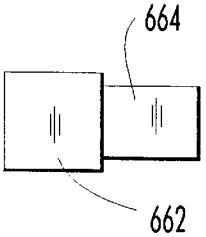

FIGS. 6G and 6I illustrate a 3-way corner connector having a base 654 with projections 656, 658, and 660. The projections are not in line with each other so that each is perpendicular to the other two. This essentially would form a corner which joins three extrusions. FIGS. 6H and 6J illustrate a 2-way corner connector including a base 662 and projections 664 and 666. The 2-way connector would form a corner between two extrusions which would be joined perpendicularly by engaging the perpendicular projections 664 and 666.

Figure 7:
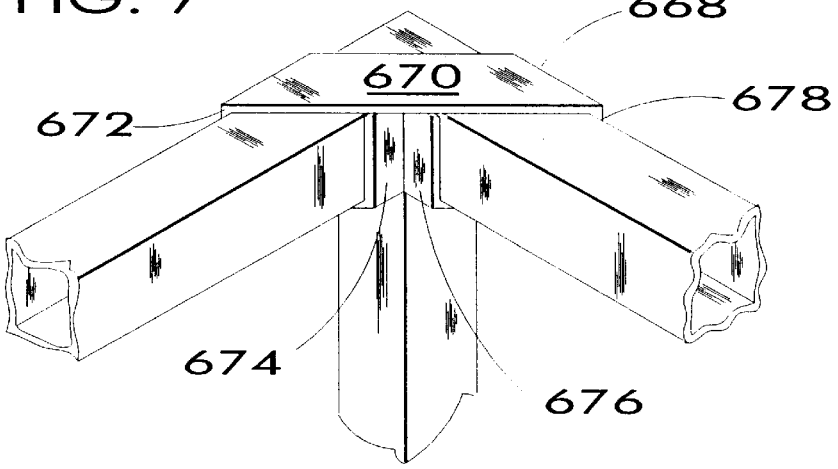
FIG. 7 is an illustration of an assembled 3-way corner of support structure according to the invention and further including a snap-on triangular support.

FIG. 7 is a perspective of a 3-way corner connector as illustrated in FIGS. 6G and 6I. In addition, a snap-on triangular support 668 has been added to diagonally connect two perpendicular extrusions adding additional rigidity, if needed, to the base structure. The triangular support 668 includes a diagonal 670 and four legs 672, 674, 676, and 678 which project downwardly in the drawing as illustrated to engage the extrusions. It is contemplated that the triangular support 668 may be made of a spring metal so that it would snap on or clip on to the perpendicular extrusions which it joins.

Figure 8:
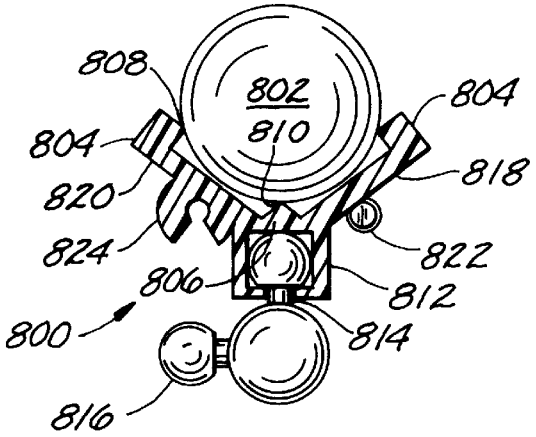
FIG. 8 is a transverse cross sectional view of one preferred embodiment of a poly carbonate track section according to the invention.

FIG. 8 illustrates a cross-section of a track 800 according to the invention. Track 800 is designed to guide a ball 802 as the moving element and has a tri-rail configuration. In particular, two outer rails 804 opposite each other hold the ball 802 in place over a lower rail 806. Rails 804 have a rectangular or square cross-section so that only one edge 808 of the rail is in contact with the ball 802. This reduces friction between the ball and the rail. The rectangular or square cross-section also adds strength to the structure of the track 800. Lower rail 806 has a triangular cross-section with the top edge only in contact with the ball 802. In fact, the ball rides on the edge 810 of lower rail 806 in order to further reduce friction. The lower rail 806 has an integral continuous channel 812 having a slot 814 in its underside. The channel is for engaging a ball connector 816 shown in phantom. The ball connector 816 will be described in more detail below. The track includes sides 818 and 820 which are an integral part of the track and join the channel 812 and lower rail 806 to the side rails 804. Side 818 has an integral rod 822 which axially projects therefrom and beyond the end of the track. Side 820 has a circular, axial slot 824 which is on the underside of side 820 for receiving a rod projecting from another, adjacent piece of track. The rod and circular slot join with adjacent rods and circular slots of other tracks to form a path. Preferably, track 800 would be constructed of a rigid material such as polycarbonate although other types of plastic or metal may be used for its configuration.

Figure 9:
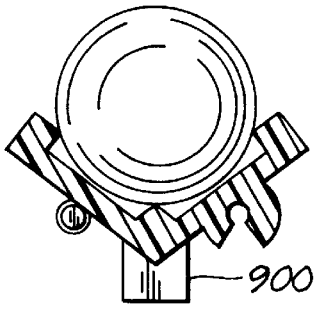
FIG. 9 is a transverse cross-sectional view of another preferred embodiment of a track section according to the invention.
Figure 10:
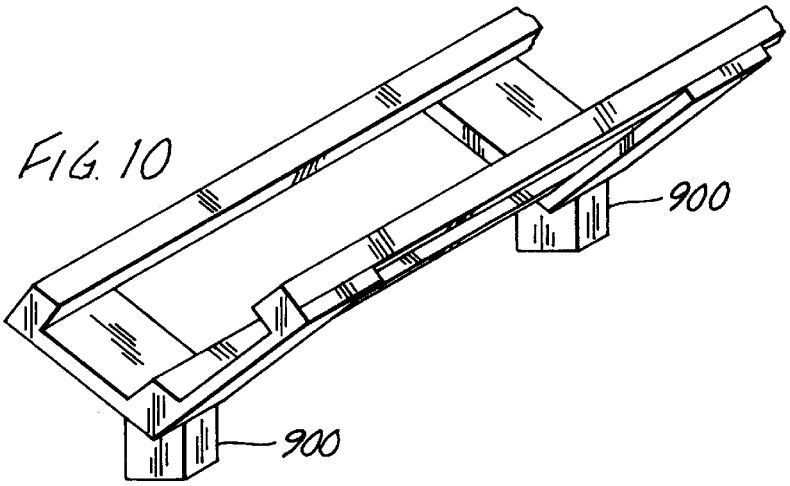
FIG. 10 is a perspective view of the track section of FIG. 10.

FIGS. 9 and 10 illustrate another preferred embodiment of the track structure in which mounting pegs 900 replace the channel 812 for engaging the ball connector. This configuration provides less flexibility for the positioning of the ball connector along the track but may reduce manufacturing costs or permit a track design which is more easily assembled.

Figure 11:
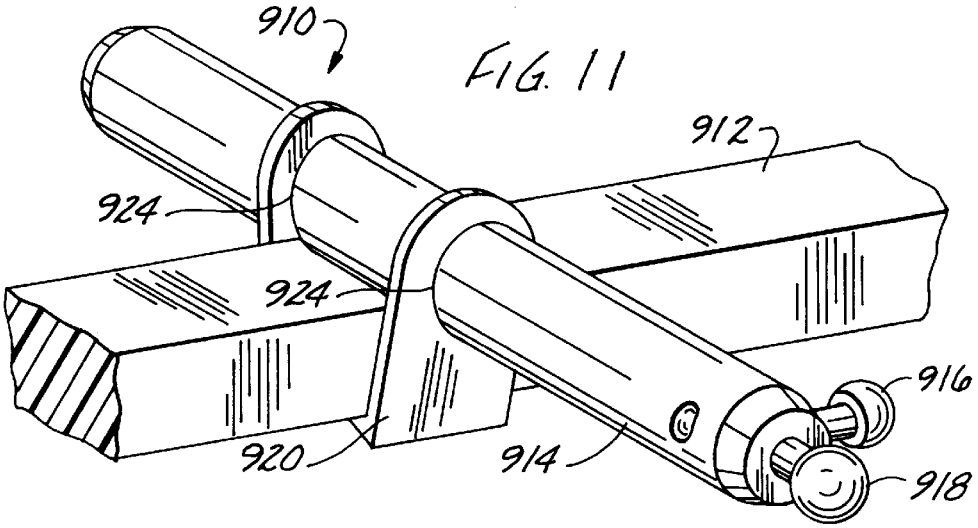
FIG. 11 is a perspective view of one preferred embodiment of a mounting bracket according to the invention for mounting a track section to the support structure.
Figure 12:
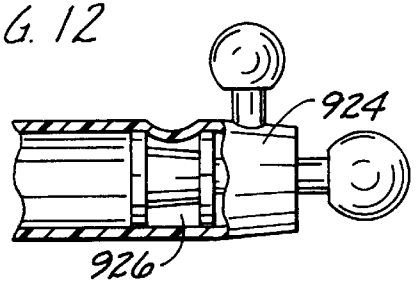
FIG. 12 is another preferred embodiment, partially in section of an end of a lateral tubing portion of a support bracket according to the invention.
Figure 13:
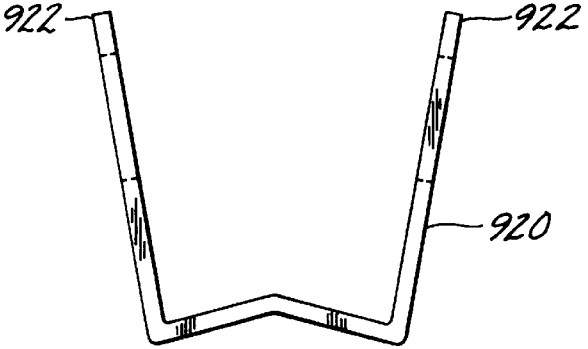
FIG. 13 is an end view of a preferred embodiment of a locking clamp according to the invention.

FIGS. 11, 12, and 13 illustrate a connector 910 according to the invention. As shown in FIG. 11, the connector 910 is in place on an extrusion 912 and includes a section of aluminum tubing 914 which terminates at both ends into a ball connector projecting from and perpendicular to the axis of the tubing 914. Additionally, an optional ball connector 918 at the end of the tubing 914 may also be provided. The tubing 914 is held in place on the extrusion 912 by a spring loaded clamp 920 as shown in the unloaded position in FIG. 13. The legs 922 of clamp 920 are squeezed together so that the holes 924 in the legs are in registry and receive the aluminum tubing 914 therein. The ends of the tubing may be chamfered for ease of insertion. When released, the legs 922 tend to take the position as shown in FIG. 13 which essentially locks the tubing in place on the extrusion 912. As shown in FIG. 12, the ball connector 916 and optional ball connector 918 may be formed on a collar 924 which is inserted into each end of the tubing 914 and held in place by crimping the tubing or otherwise placing a dimple for engaging the annular groove 926 formed in the collar.

Figure 14C:
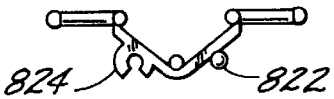
FIGS. 14A, 14B, and 14C show top, front and side views, respectively, of a long straight section track of one preferred embodiment according to the invention.
Figure 14A:
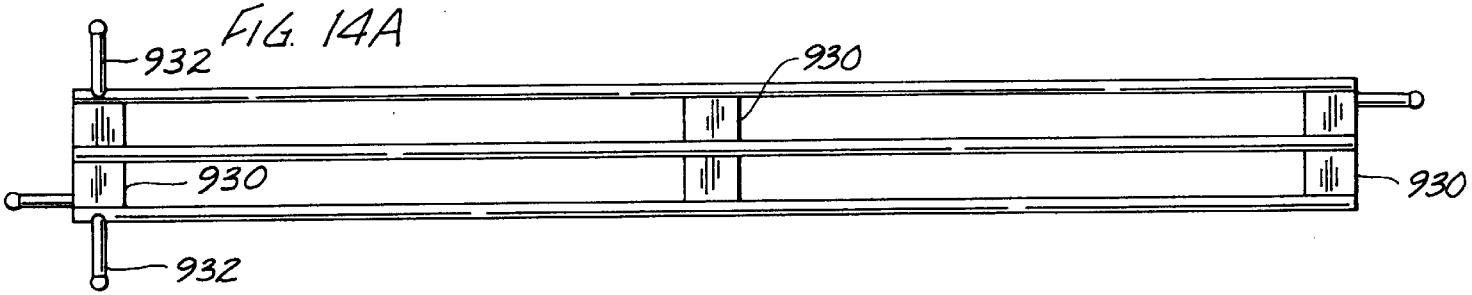
Figure 14B:
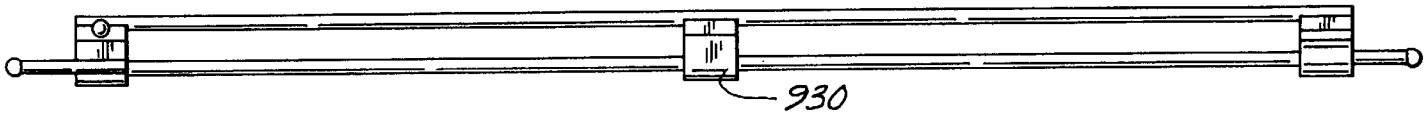

FIGS. 14A, 14B, and 14C illustrate another preferred embodiment of a long, straight track. In this configuration, each of the three rails has a circular cross-section and is essentially an elongated rod joined together by cross pieces 930. As in the FIG. 8 design, each end of the track is provided with a projecting rod 822 and a circular receiving slot 824 for interlocking two tracks which are in line with each other. Alternatively, the track may be provided with lateral projections 932 for engaging an opening in the support base.

Figure 15A:
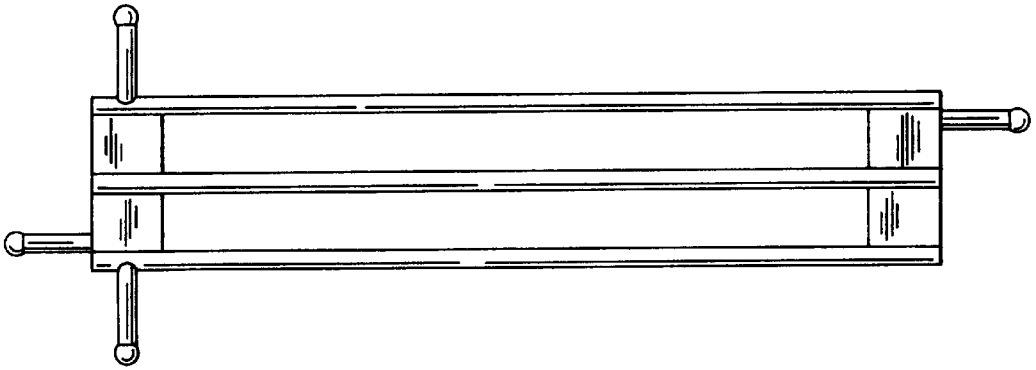
FIGS. 15A, 15B, and 15C show top, front and side views, respectively, of a short straight section track of one preferred embodiment according to the invention.
Figure 15B:
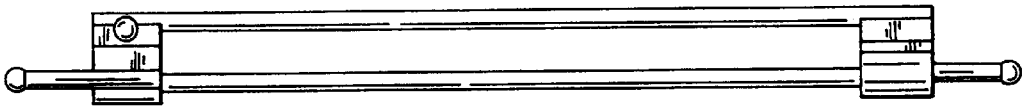
Figure 15C:
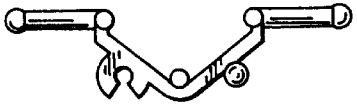

FIGS. 15A, 15B, and 15C illustrate an embodiment of a short straight track similar to the track of FIGS. 14A, 14B, and 14C in that rails of circular cross section are used.

Figure 16:
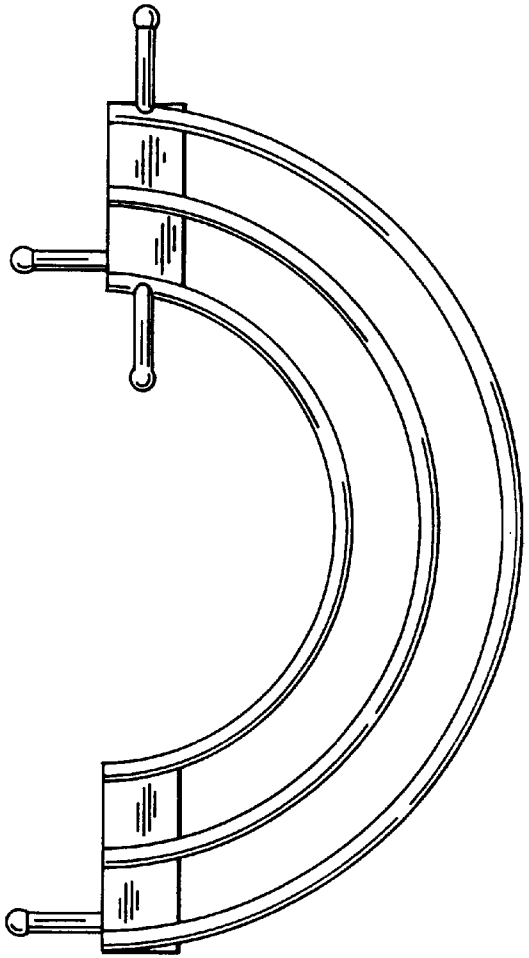
FIG. 16 shows a side view of an 180 degree turn track of one preferred embodiment according to the invention.

FIG. 16 illustrates a 180° turn track which would be used to change the direction of movement of the moving element. Once again, the track is a tri-rail configuration. As illustrated in FIG. 16, the rails have a circular cross section. However, it is also contemplated that any of the illustrated circular rail tracks may have side rails having a rectangular cross section as shown in FIG. 8 and having a bottom rail with a triangular configuration as shown in FIG. 8.

Figure 17:
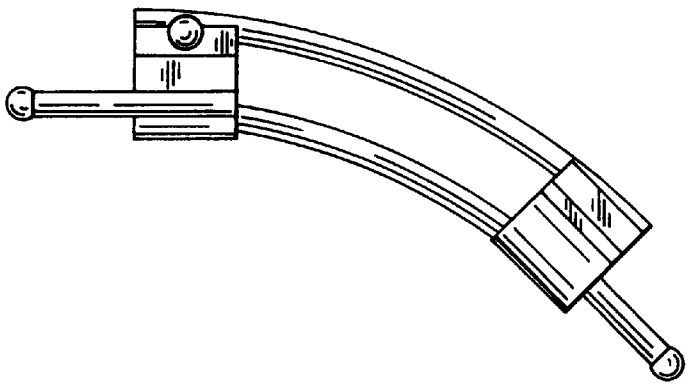
FIG. 17 shows a side view of a small outside coaster section 45 degrees track of one preferred embodiment according to the invention.

FIG. 17 illustrates a small outside coaster section which would direct the ball through a 45° turn downward. Once again, it is illustrated with rails of circular cross section. Although, rectangular and triangular cross sections so that the ball is travelling on an edge is contemplated.

Figure 18:
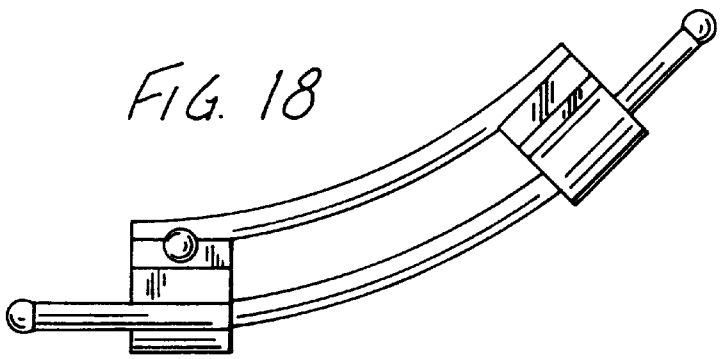
FIG. 18 shows a side view of a small inside coaster section 45 degrees track of one preferred embodiment according to the invention.

FIG. 18 illustrates a small inside coaster section which would move the ball through a 45° angle upward from left to right.

Figure 19:
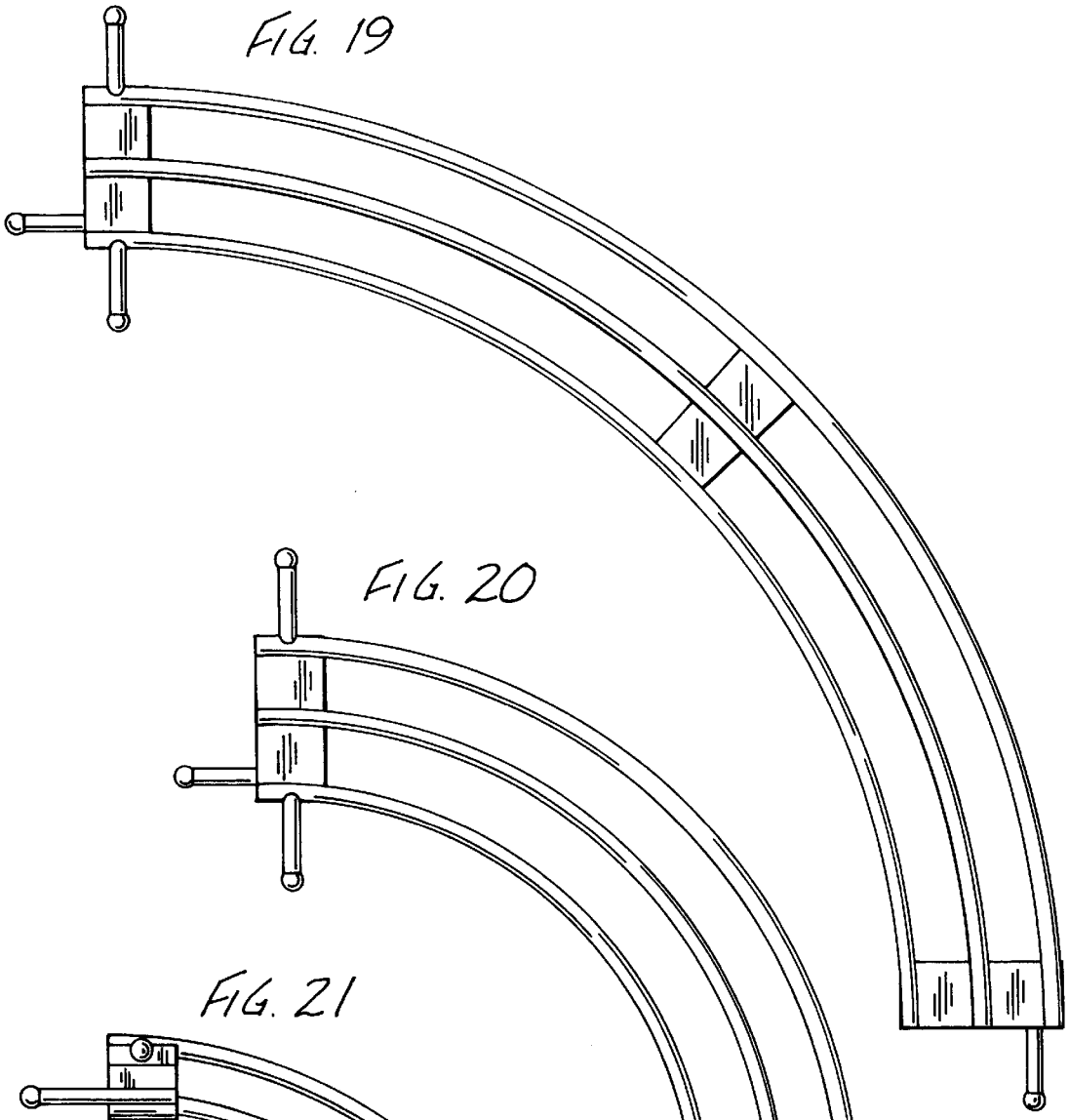
FIG. 19 shows a top view of a large 90 degree curve track of one preferred embodiment according to the invention.

FIG. 19 is a top view of a large 90° curve of track which changes the direction of the moving ball. When the ball exits the moving track, it will be travelling in a direction which is perpendicular to the direction it was travelling when it entered the track.

Figure 20:
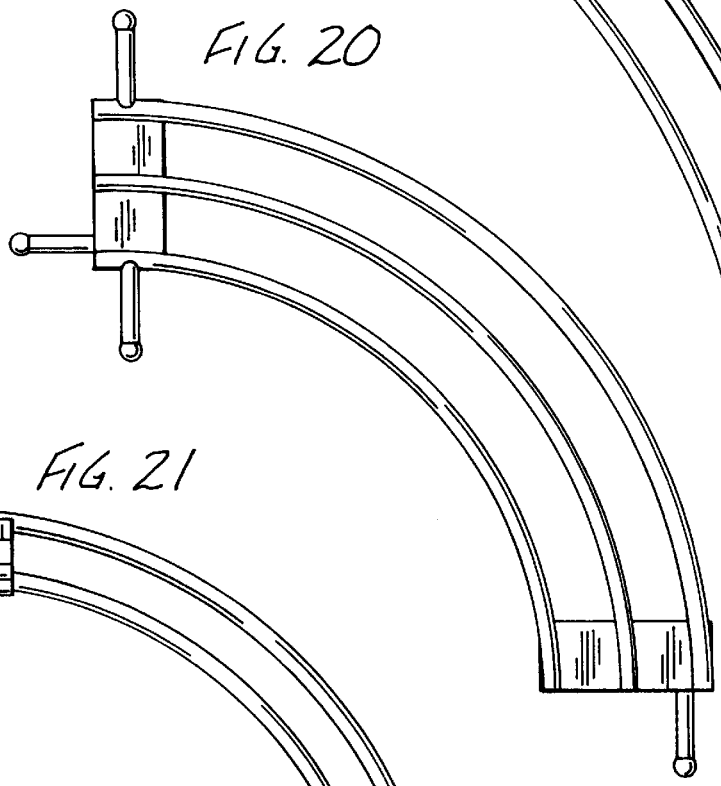
FIG. 20 shows a top view of a small 180 degree curve track of one preferred embodiment according to the invention.

FIG. 20 is a small 90° curve section of track. The difference between the tracks of FIGS. 19 and 20 is the radius of curvature. Preferably, the track of FIG. 19 would have approximately a 6 inch radius of curvature whereas the track of FIG. 20 would have a 3 inch radius of curvature.

Figure 21:
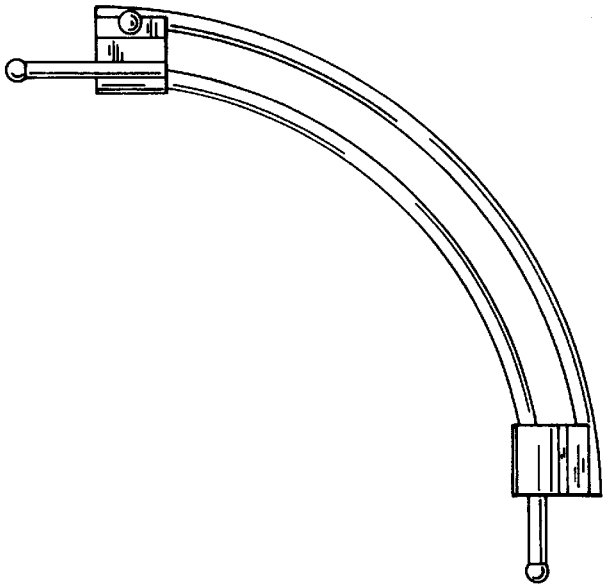
FIG. 21 shows a side view of a large outside coaster section 90 degrees track of one preferred embodiment according to the invention.

FIG. 21 is a large outside coaster section which would be a section of track for moving the ball from a substantially horizontal path to a substantially vertical path. In other words, it would change the direction of the movement of the ball by an angle of 90° downward.

Figure 22A:
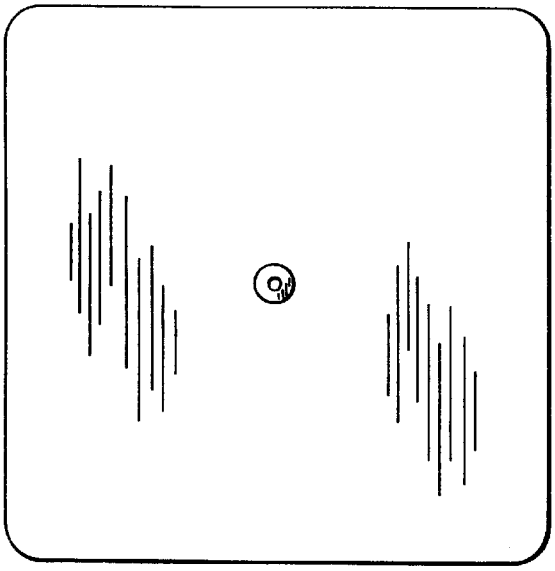
FIGS. 22A and 22B show top and side views, respectively, of a base plate support toy piece of one preferred embodiment according to the invention.
Figure 22B:
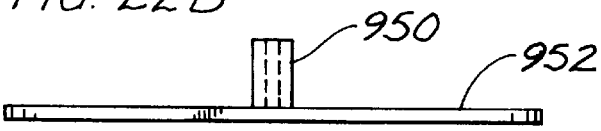

FIGS. 22A and 22B illustrate a base plate 952 which is an alternative to the support structure of FIGS. 4 and 5.

Figure 23:
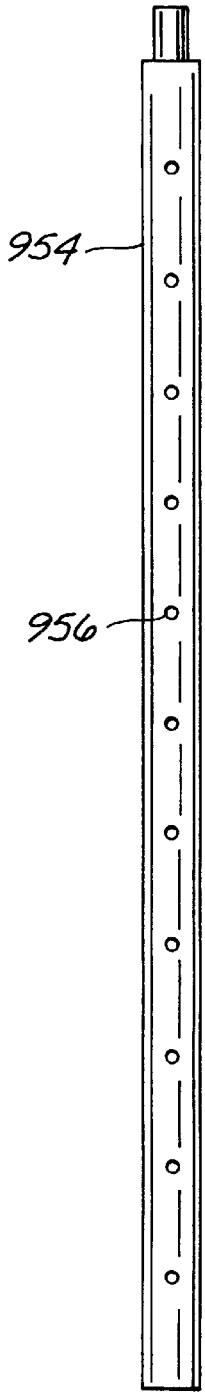
FIG. 23 shows a side view of a column support piece of one preferred embodiment according to the invention.
Figure 24:
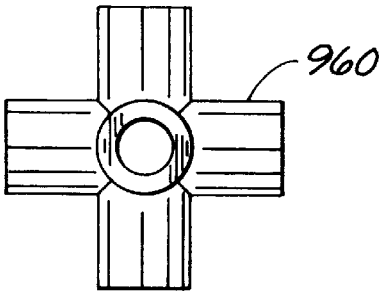
FIG. 24 shows a top view of a column joint support piece of one preferred embodiment according to the invention.
Figure 25:
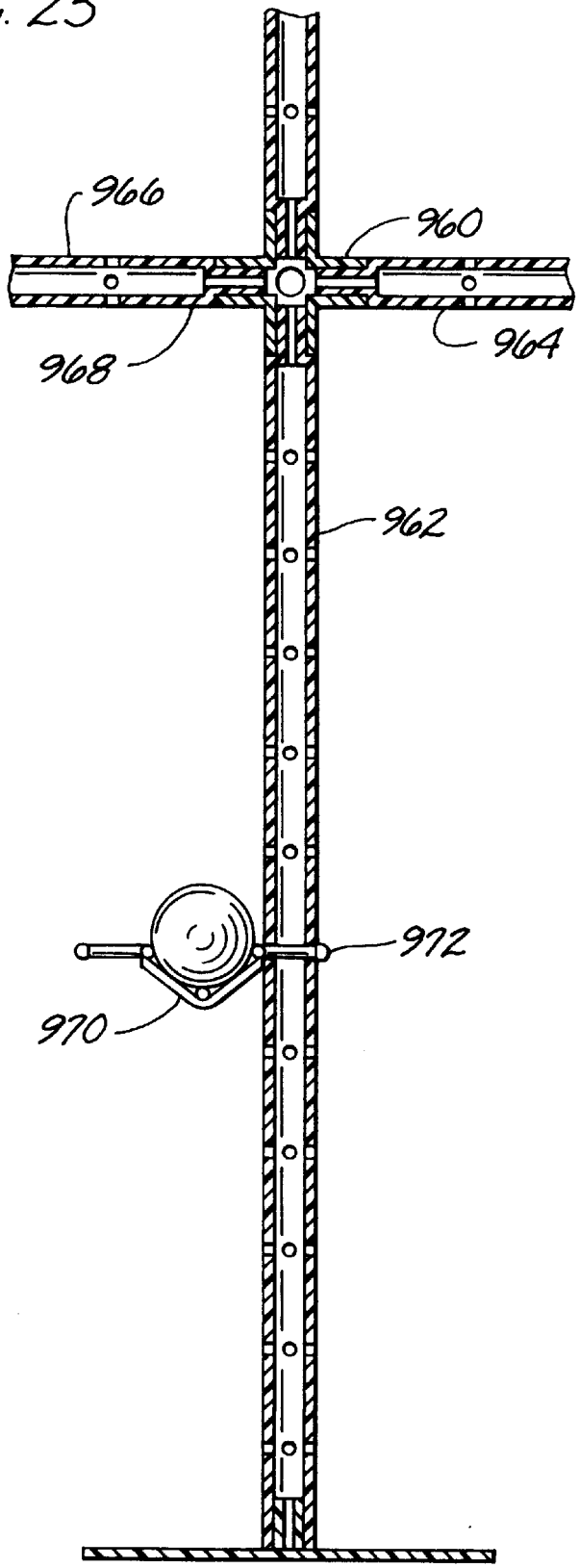
FIG. 25 shows a partial cross sectional view of a section of assembly including a column on a base plate support, the column engaging a straight track section and a column joint support piece, according to one preferred embodiment of the invention.
Figure 26:
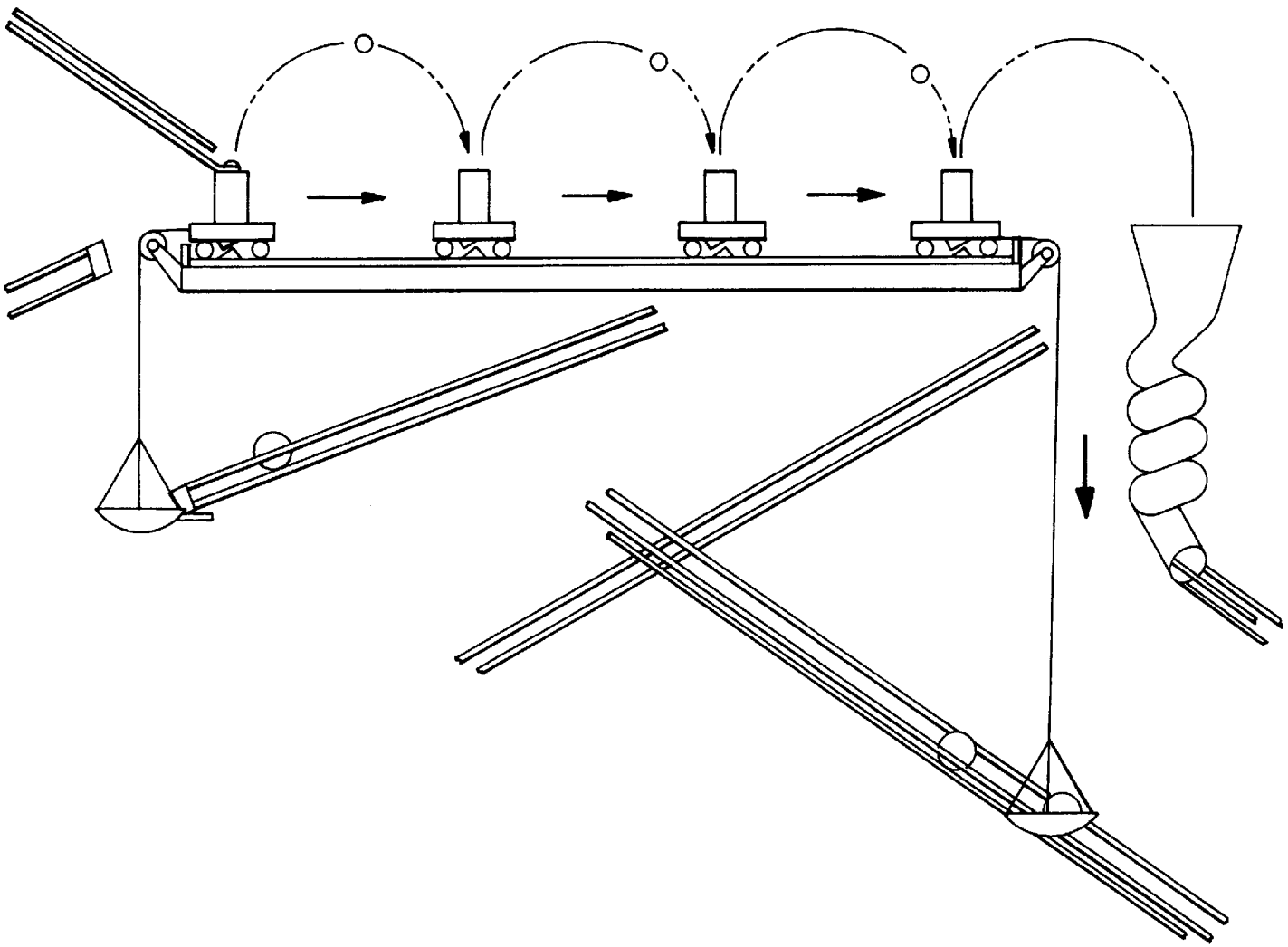
Figure 27:
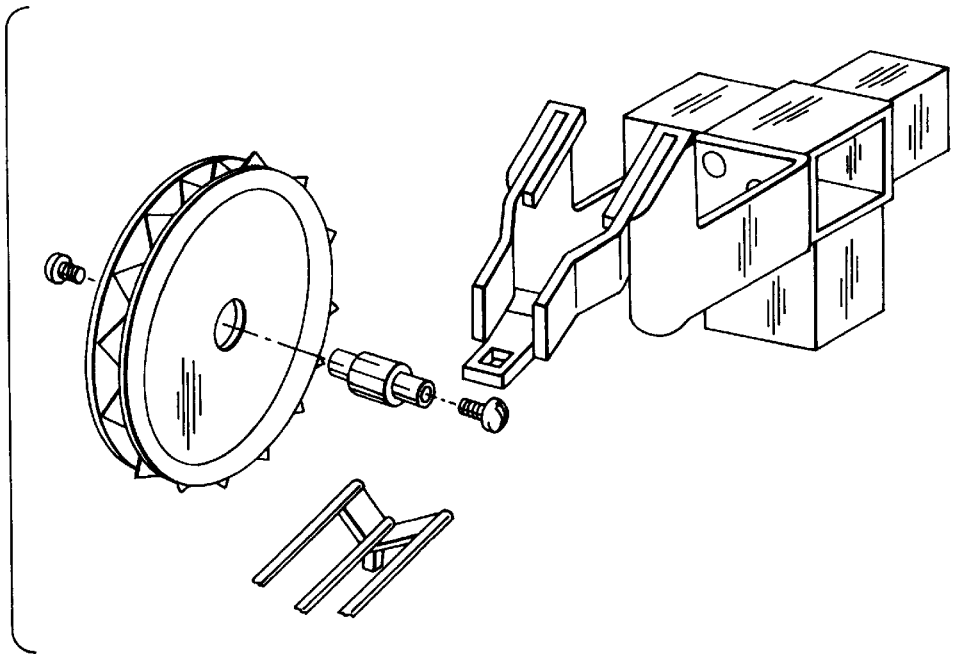
Figure 28:
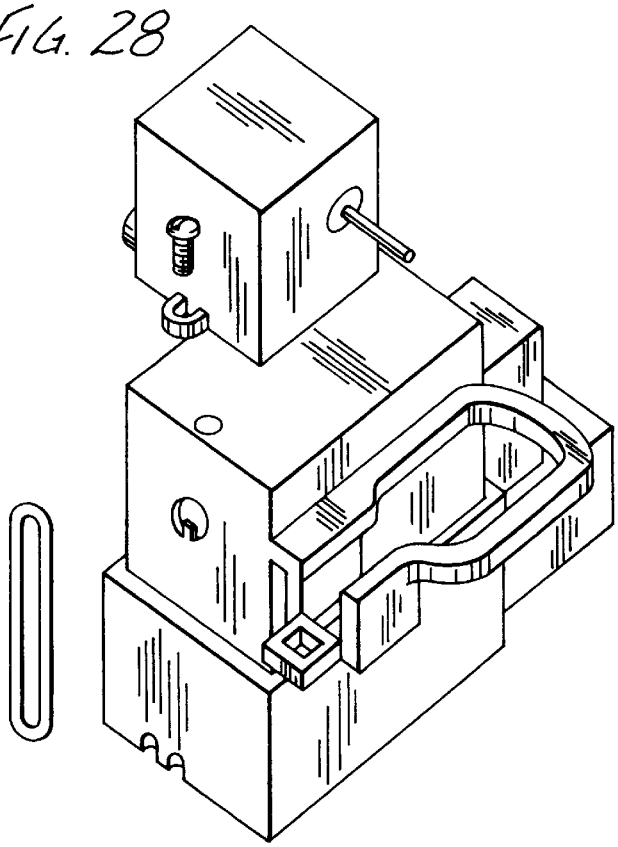
Figure 30:
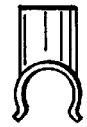
Figure 31C:
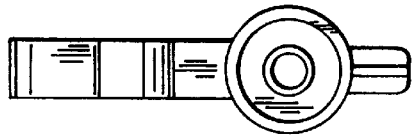
FIGS. 31A, 31B and 31C illustrate a pendulum gate rotor.
Figure 29B:
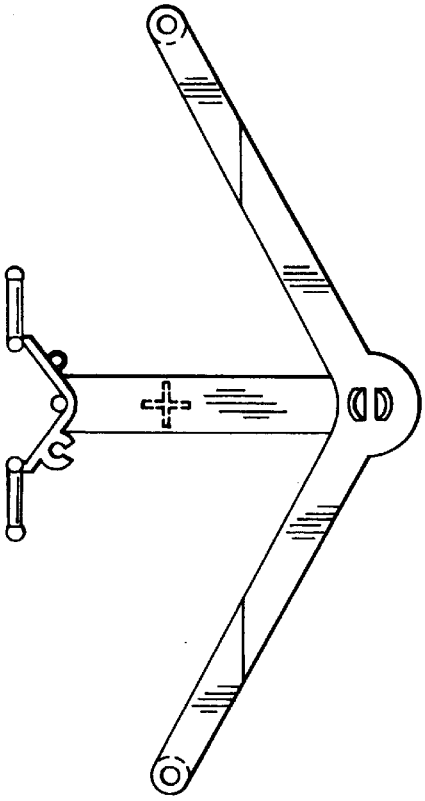
Figure 31B:
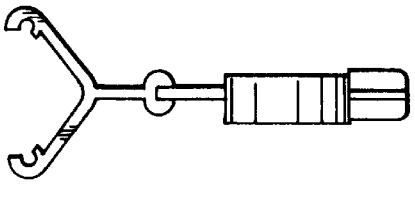
Figure 29A:
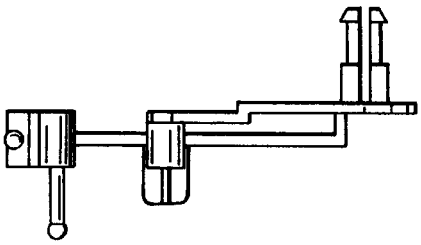
Figure 31A:
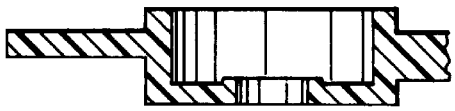
Figure 32A:
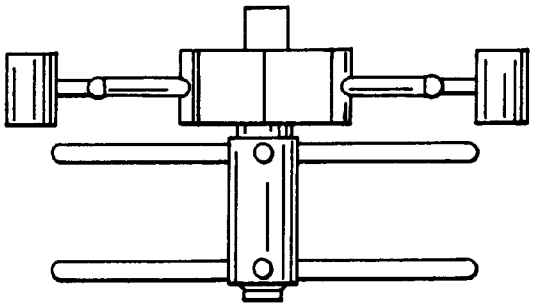
FIGS. 32A and 32B illustrate a flip-flop gate.
Figure 32B:
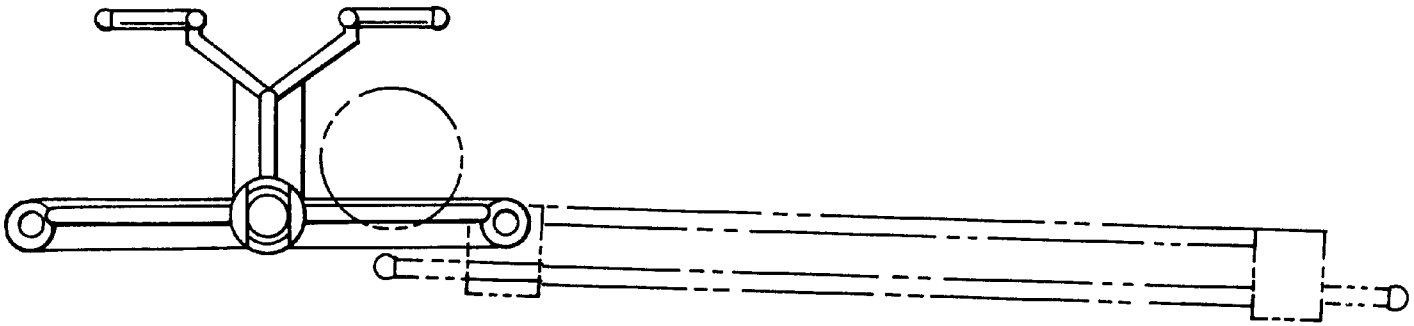
Figure 33A:
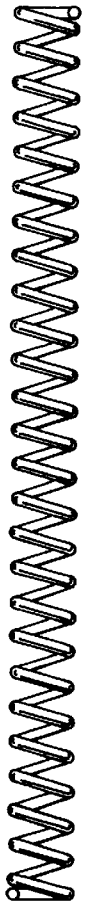
FIGS. 33A, 33B and 33B illustrate an archimedean screw elevator scheme.
Figure 33B:
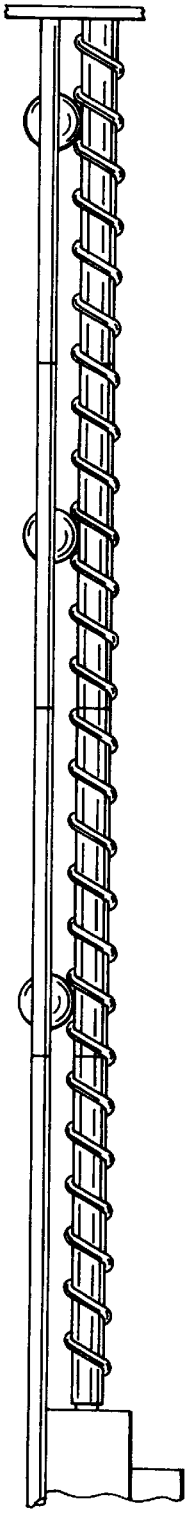
Figure 33C:
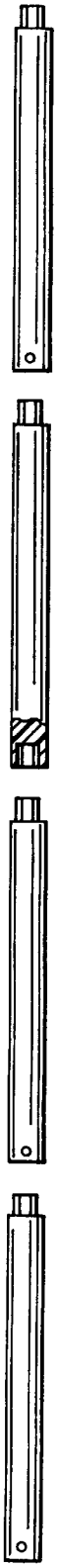
Figure 34:
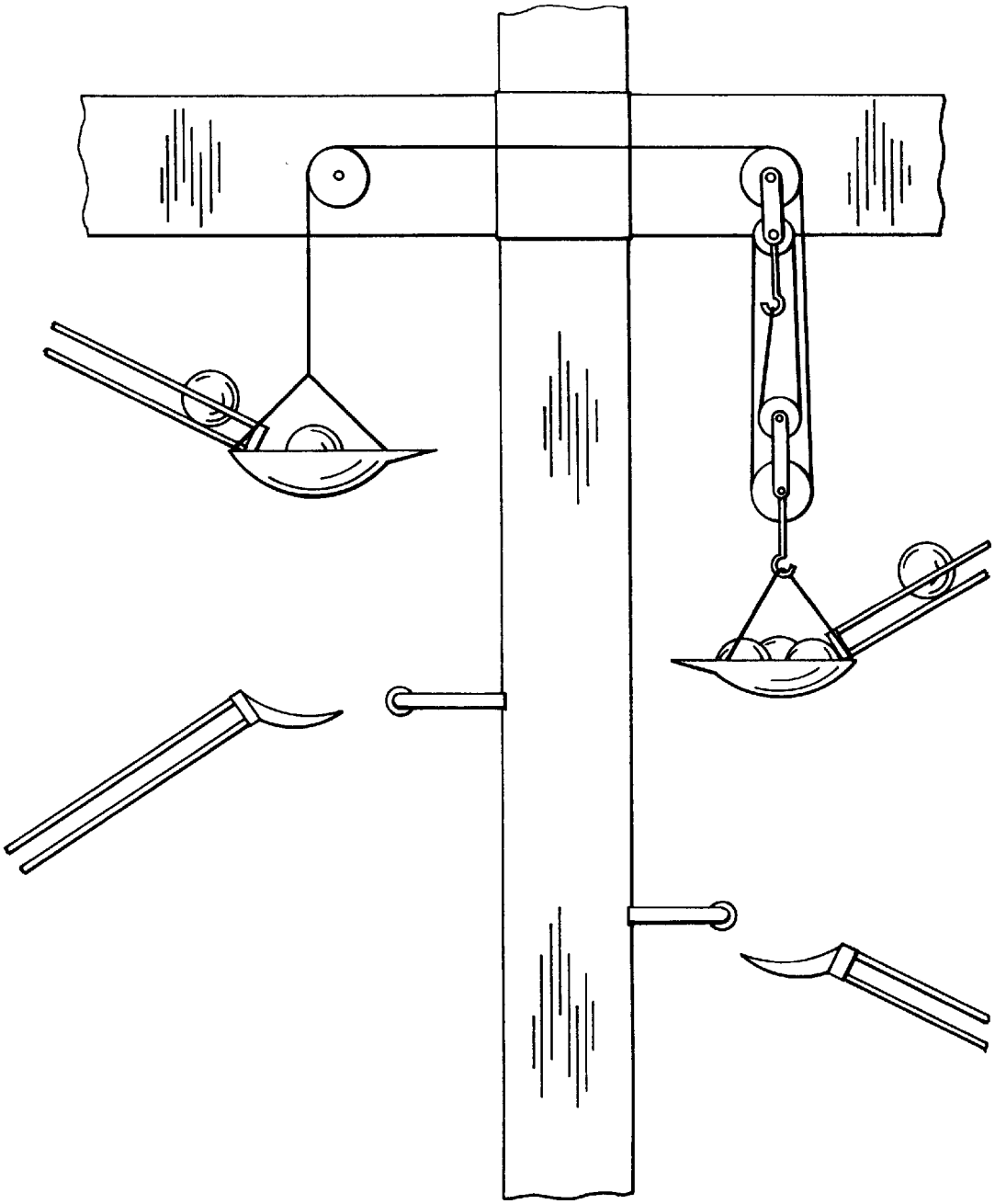
Figure 35:
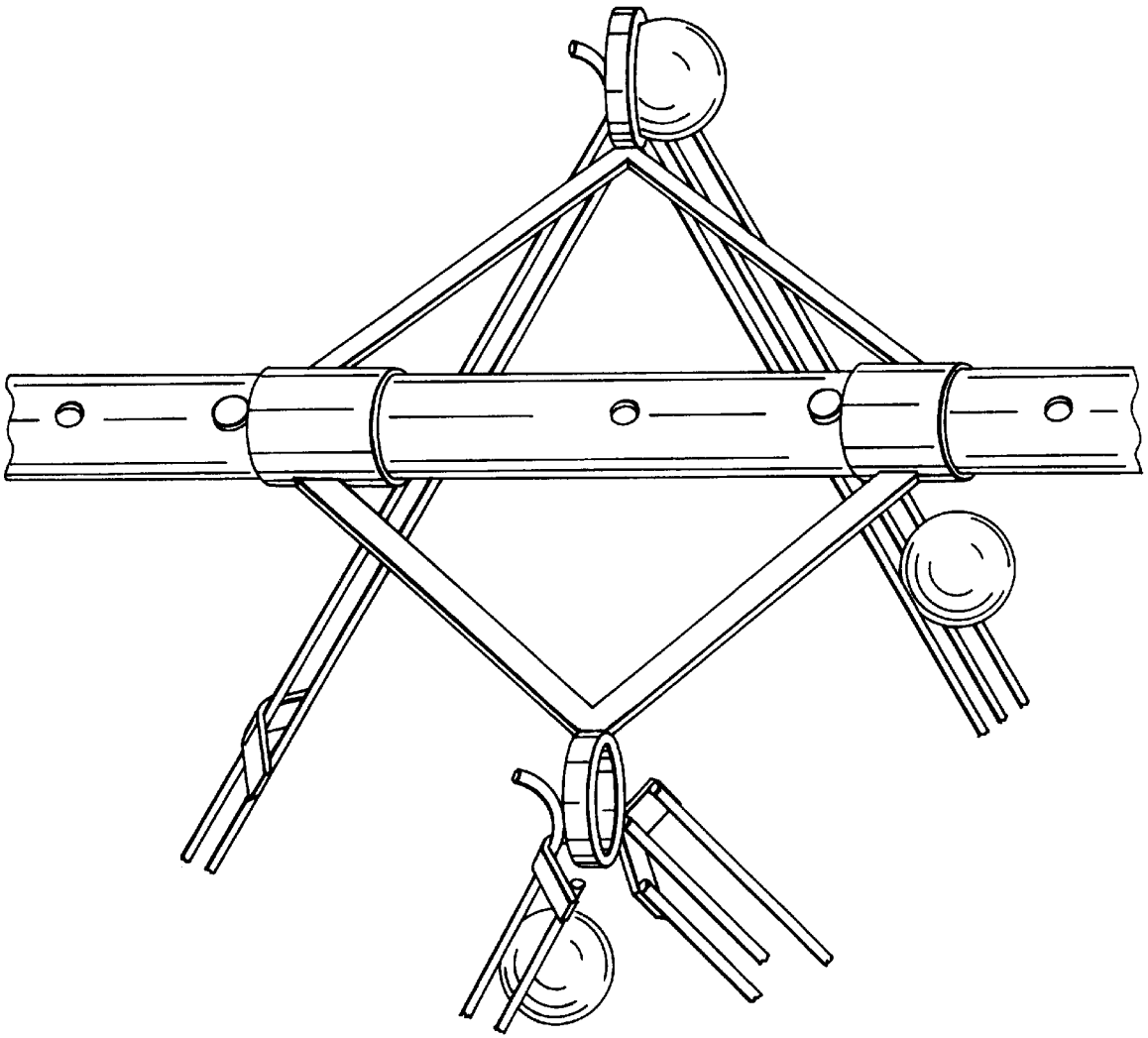
Figure 36:
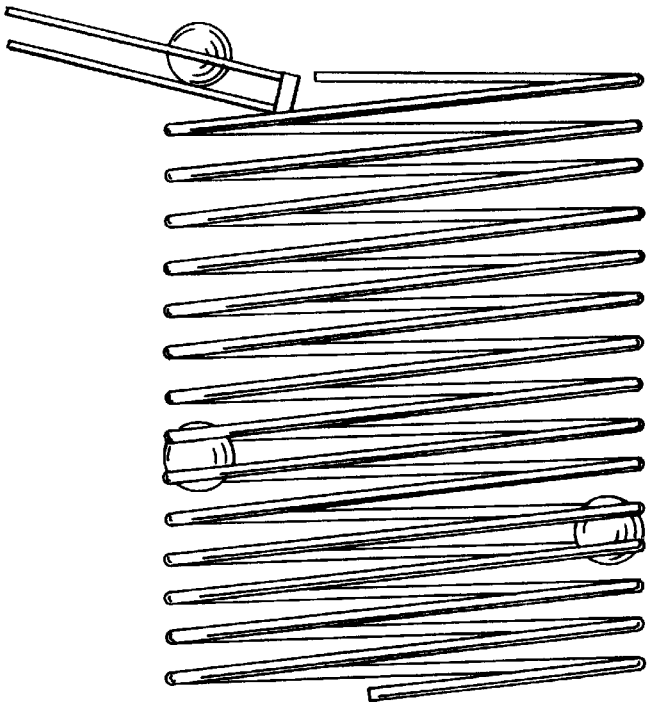
Figure 37:
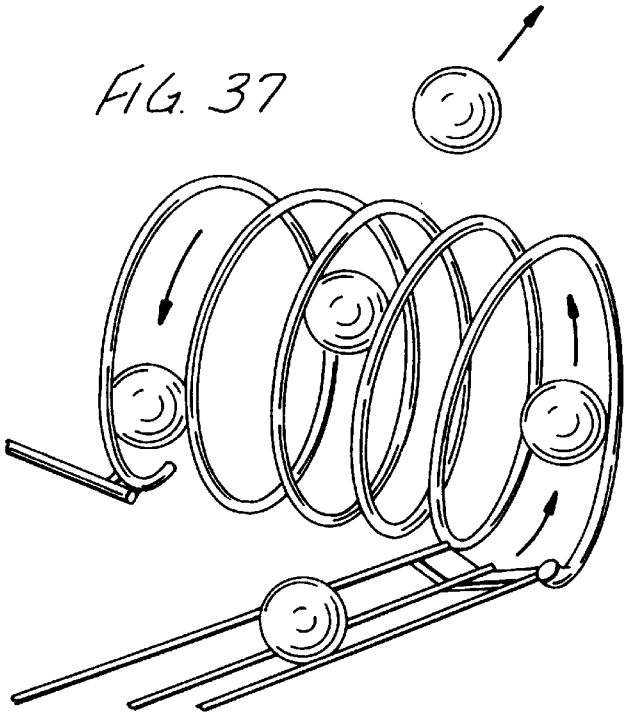
Figure 38:
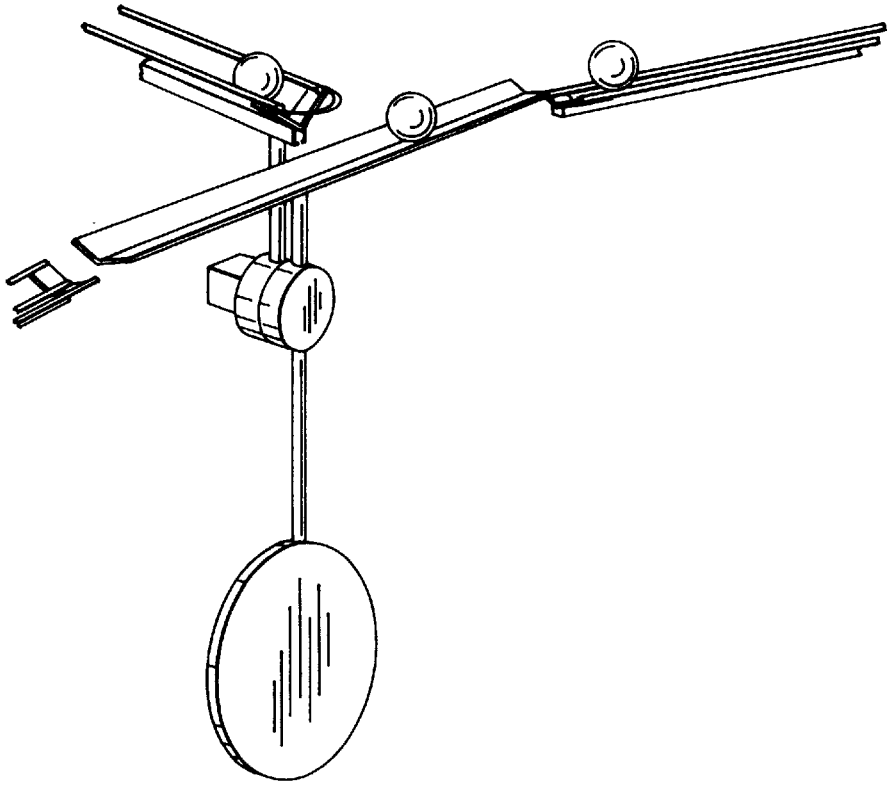
Figure 39:
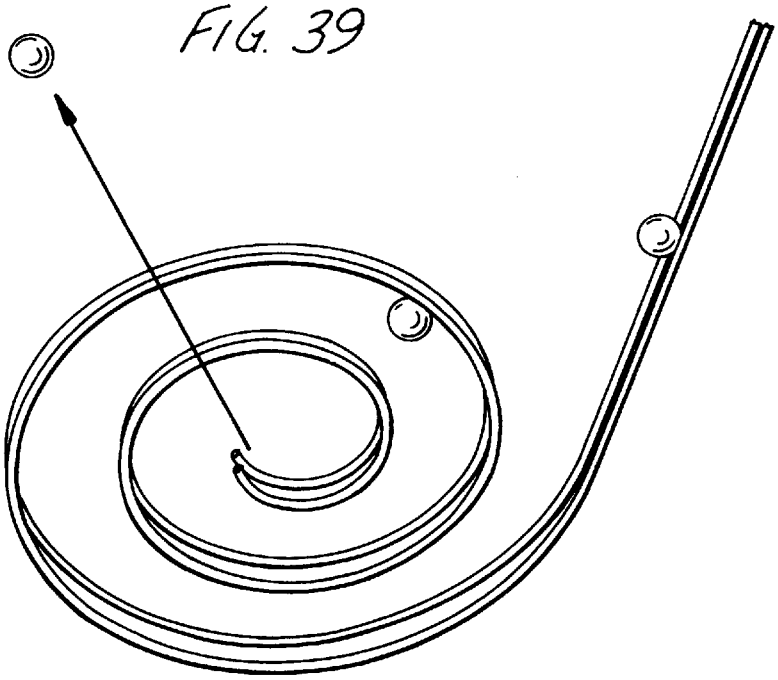
Figure 40:
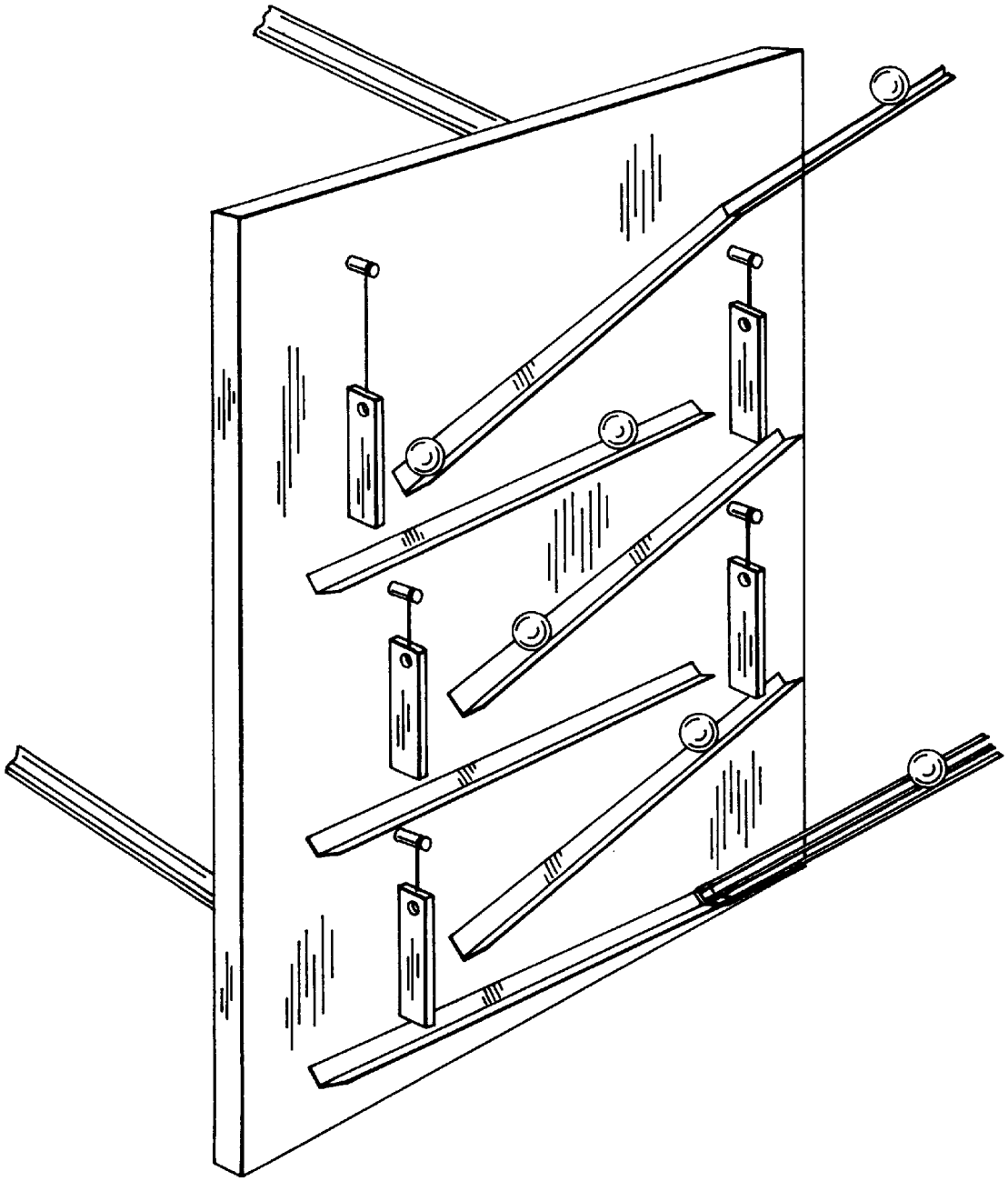
Figure 41:
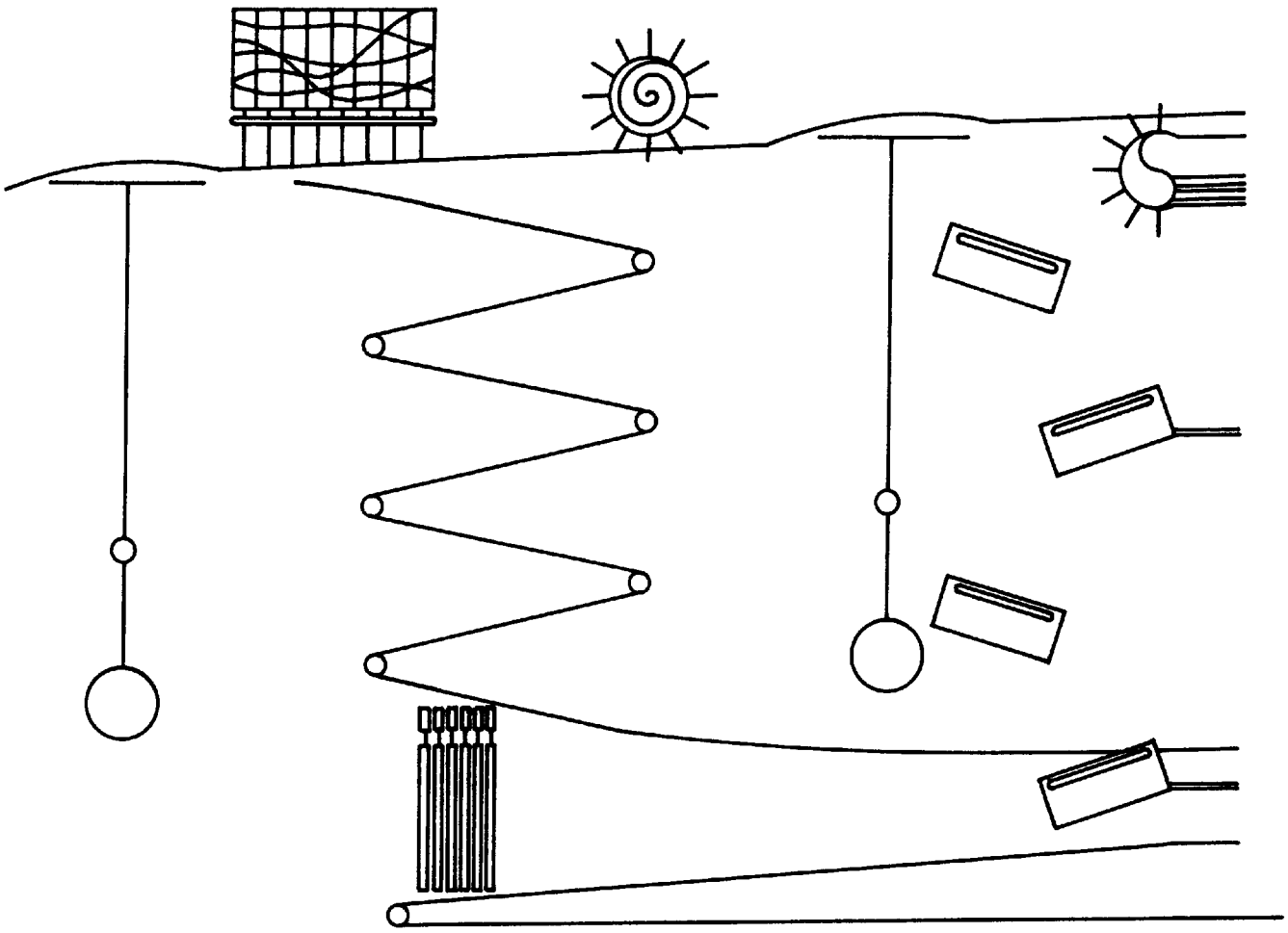
FIG. 41 illustrates a side view of one layout according to the invention including several stunts.

FIG. 23 illustrates a vertical column which would be vertically supported by a vertical support 950 of the base plate 952. The base plate 952 is essentially a flat, planar surface which would rest on a floor or table and has a perpendicular projecting member 950 for engaging the column 954. The column has openings 956 therein for receiving the projections 932 (see FIG. 14A) of the track. This connection between the projections 932 and openings 956 allow the track to be held in place. It is contemplated that several columns 954 may be joined together by a column joint as illustrated in FIG. 24. In particular, FIG. 24 illustrates a 4-way column joint. FIG. 25 illustrates the 4-way column joint 960 engaging four columns 962, 964, 966 and 968. In addition, FIG. 25 shows a section of track 970 having a projecting rod 972 engaging one of the openings 956 of the column 962.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A toy for use with a computer having a display comprising:

a plurality of interconnecting hardware toy pieces; and a toy design system software for operating the computer including:

an inventory database for storing an inventory of the toy pieces;

an inventory database manager module for updating the inventory database in response to player input;

a design layout module for creating and modifying a toy layout in response to player input using software representations corresponding to the inventory of the toy pieces and conforming to a plurality of design rules, and for generating a screen indicating the toy layout; and a layout database storing the toy layout created by the player using the toy design system.

2. The toy of claim 1 wherein the plurality of hardware toy pieces comprise a predetermined quantity of the hardware toy pieces and wherein the inventory stored in the inventory database comprises the predetermined quantity.

3. The toy of claim 2 wherein the toy design system software further comprises:

a layout completion module, responsive to the inventory database and the layout database, comparing the inventory to the toy layout to determine whether the toy layout can be completed using the predetermined quantity of the hardware toy pieces; and means for indicating on the display whether the toy layout can be completed using the predetermined quantity of the hardware toy pieces.

4. The toy of claim 1 further comprising a moveable element and wherein the hardware toy pieces further comprise a plurality of interconnecting tri-rail tracks on which the movable element is guided.

5. The toy of claim 4 wherein the movable element comprises a ball.

6. The toy of claim 4 wherein the tracks include straight and curved horizontal tracks, and straight and curved vertical elevation rising and vertical elevation decreasing tracks which interconnect to form a path upon which the moveable element is horizontally and vertically guided.

7. The toy of claim 4 further comprising a support structure including a plurality of extruded lengths of square cross section interconnected by connectors having projection engaging bores in the ends of the lengths.

8. The toy of claim 4 wherein the hardware toy pieces further comprise stunt pieces which are interposed with the tracks in the toy layout to direct the moveable element in horizontal and vertical directions including an elevator which moves the moveable element in a vertical direction.

9. The toy of claim 4 wherein the toy design system software further comprises:

a design analysis module, responsive to the layout database, which analyzes the toy layout based on scientific and mathematical principles to determine whether the movable element will continuously move about the tracks as configured in the toy layout.

10. The toy of claim 4 wherein the toy design system software further comprises a simulation module, responsive to the layout database and player input, indicating on the display a simulation of substantially real-time movement of the movable element on the tracks as configured in the toy layout.

11. The toy of claim 4 wherein the toy design system software further comprises an education module for indicating on the display scientific and mathematical principles relevant to the toy layout and the guided movement of the moveable element by the tracks.

12. The toy of claim 11 wherein the education module includes a plurality of education levels of scientific and mathematical principles, and the toy design system software further comprises:

an education level database for storing one of the education levels, and an education level sector module, responsive to player input, to select one of the education levels;

wherein the education module, responsive to the education level database, indicates on the display scientific and mathematical principles corresponding to the one selected education level.

13. The toy of claim 1 wherein the toy design system software further comprises a design assistance module, responsive to the inventory database and the toy layout database, wherein the design assistance module indicates on the display toy layout design suggestions.

14. The toy of claim 1 wherein the toy design system software further comprises a layout library module, responsive to the layout database, wherein the layout library module indicates on the display the toy layouts stored in the layout database.

15. The toy of claim 2 wherein the toy design system software further comprises a layout library module, responsive to the toy layout database and the inventory database, wherein the layout library module indicates on the display the toy layouts stored in the layout database that can be completed using the predetermined quantity of toy pieces stored in the inventory database.

* * * * *